US007131312B2

(12) United States Patent
Yoshino et al.

(10) Patent No.: US 7,131,312 B2
(45) Date of Patent: Nov. 7, 2006

(54) PIPE BENDING APPARATUS AND METHOD

(75) Inventors: Tamio Yoshino, Iwata (JP); Yoji Tashiro, Iwata (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 299 days.

(21) Appl. No.: 10/617,332

(22) Filed: Jul. 10, 2003

(65) Prior Publication Data

US 2004/0007037 A1 Jan. 15, 2004

(30) Foreign Application Priority Data

Dec. 25, 2000 (JP) ..... 2000-393172
Dec. 25, 2000 (JP) ..... 2000-393226
May 6, 2001 (JP) ..... 2001-137280

(51) Int. Cl.
*B21D 9/15* (2006.01)

(52) U.S. Cl. ..... 72/369; 72/370.22

(58) Field of Classification Search ..... 72/369, 72/370.22
See application file for complete search history.

(56) References Cited

U.S. PATENT DOCUMENTS 3,739,615 A * 6/1973 Tressel ..... 72/57
5,129,247 A * 7/1992 Johnson ..... 72/60
5,263,350 A * 11/1993 Crippa ..... 72/157
5,613,394 A * 3/1997 Kawamura et al. ..... 72/369
5,865,054 A * 2/1999 Roper ..... 72/58

OTHER PUBLICATIONS

Japanese Article entitled: "Bending Method and Production System for Thin-Walled Pipe (Hydro-Bending)", Yamaha Motor Technical Review pp. 87-96. (with English Abstract).
Japanese Article from Plant Engineer. vol. 34 No. 1, Jan. 2002. pp. 40-46.

* cited by examiner

*Primary Examiner*—Lowell A. Larson
(74) *Attorney, Agent, or Firm*—Knobbe, Martens, Olson & Bear, LLP

(57) ABSTRACT

A pipe bending apparatus for performing a pipe bending method, wherein the method includes filling a workpiece with a liquid, pressurizing the liquid to a target pressure level, and bending the workpiece to create a bent pipe. Preferably, the pressure level is inversely proportional to the radius of the bend in the pipe. Furthermore, preferably the pressure is directly proportional to the bending angle of the pipe. Preferably, the pressure is maintained substantially at the target pressure during the bending process. Optionally, the pressure level can be increased during the bending process.

17 Claims, 16 Drawing Sheets

PIPE BENDING APPARATUS AND METHOD

RELATED APPLICATIONS

The present application is based on Japanese Patent Application No. 2000-393172, filed Dec. 25, 2000, Japanese Patent Application No. 2001-137280, filed May 8, 2001, and Japanese Patent Application No. 2000-393229 filed Dec. 25, 2000, the contents of each of which is hereby expressly incorporated by reference.

BACKGROUND OF THE INVENTION

1. Field of the Invention

The present application relates generally to an apparatus and method for bending a pipe and, more particularly, to an apparatus and method for introducing pressurized liquid into the interior of a pipe during bending to maintain the cross-sectional shape of the pipe.

2. Description of the Related Art

Vehicles powered by internal combustion engines, such as motorcycles, automobiles, snowmobiles, and all-terrain vehicles, for example, typically include an exhaust system to guide exhaust gases from one or more combustion chambers of the engine to the atmosphere. The exhaust system typically includes one or more exhaust pipes extending from the combustion chamber, or chambers, to a muffler of the exhaust system. A typical exhaust pipe is often circular in cross-section and can contain numerous bends throughout its length in order to tightly conform to the space available in such vehicles. It is generally desirable to maintain a consistent cross-sectional area and shape of the exhaust pipe in order to permit unobstructed flow of exhaust gases through the exhaust pipe. Changes in cross-sectional area or shape of the exhaust pipe tend to disrupt the flow of exhaust gases and/or partially reflect pressure waves, which can reduce the power output of the engine, especially at high engine speeds.

Commonly, exhaust pipes are fabricated by bending a generally linear, hollow workpiece around a circular die. However, when a tubular workpiece is bent, the outer side of the workpiece tends to collapse toward the inner side in the absence of internal support. That is, the cross-sectional dimension of the workpiece in a plane normal to the bending axis is reduced. Thus, the cross-sectional area of the exhaust pipe can also be reduced at the bent portion.

In order to provide support to an interior surface of the pipe, a mandrel can be introduced into the pipe. However, the mandrel must be capable of bending along with the pipe. In addition, due to a lengthening of the outer surface of the pipe, relative movement occurs between the pipe and the mandrel. Accordingly, a lubricant must be used to inhibit damage to the surface of the pipe due to movement on the mandrel. For environmental concerns, the lubricant typically must be reclaimed and the pipe subjected to additional cleaning process to remove residual lubricant, which increases manufacturing costs. Furthermore, despite the use of a lubricant, the mandrel can damage the surface and/or cross-sectional shape of the pipe.

In an alternative method, liquid is sealed within the pipe and pressurized during bending to provide support to the interior surface of the pipe. In such a method, the unbent pipe, or workpiece, is positioned horizontally on the bending apparatus. A first end of the pipe is received by a clamp, which includes an integral plug assembly, which is configured to creates a liquid tight seal with the first end of the pipe. A plug assembly is also inserted into the second end of the pipe and liquid is introduced into the interior of the pipe through the first plug. Once the interior of the pipe has been filled with liquid, the liquid is pressurized and an external force is applied to the pipe to bend the pipe around a die.

SUMMARY OF THE INVENTION

An aspect of the least one of the inventions disclosed herein includes the realization that further improvements to the uniformity of the inner dimension of an exhaust pipe can be achieved with a hydro bending process during which a pressure of a liquid within a workpiece is changed during bending based on at least one of the radius of curvature of a bend and an overall angle of bending. For example, a workpiece that is manufactured in accordance with a hydro bending technique, can have more than one bend therein. The bends can have different radii of curvature and can extend through different overall angles of bending. During a bending operation, the workpiece is plastically deformed. As such, the mechanical properties of the material forming the workpiece are affected. Additionally, the localized forces acting on the workpiece to create a bend combine with the liquid pressure during bending to provide the final shape of the workpiece.

It has been found that by changing the pressure of the liquid within the workpiece during a bending operation provides a more uniform cross-sectional shape of the finished workpiece. For example, the pressure of the liquid within the workpiece can be increased as a bend is created. Preferably, the greater the angle of bending, the higher the pressure. Additionally, where higher pressures are used for bends having lower radii of curvature, the resulting pipe has better uniformity.

In accordance with another aspect of at least one of the inventions disclosed herein, a method of forming a bend in a pipe is provided. The method comprises determining a target radius of curvature of the bend, sealing an interior space of the pipe at a desired location of the bend, and filling the interior space with a liquid. Additionally, the method includes calculating a target pressure of the liquid as a function of the target radius wherein the target pressure is inversely related to the target radius. The liquid is then pressurized to a pressure substantially equal to the target pressure, and the pipe is manipulated to form a bend having a radius substantially equal to the target radius.

In accordance with yet another aspect of at least one of the inventions disclosed herein, a method of forming at least a first and a second bend in a pipe is provided. The method comprises determining a first target radius of curvature of the first bend and a second target radius of curvature of the second bend which is different from the first target radius. At least one sealed interior space is created within the pipe including the locations of the first bend and the second bend. The at least one sealed interior space is filled with a liquid. The method also,includes calculating a first target pressure of the liquid for the first bend as a function of the first radius and calculating a second target pressure of the liquid for the second bend as a function of the second radius wherein, if the second target radius is less than the first target radius, the second target pressure is greater than the first target pressure. If the second target radius is greater than the first target radius, the second target pressure is less than the target pressure of the first bend, the method includes pressurizing the liquid to a pressure substantially equal to the first target pressure and manipulating the pipe to form a first bend having a radius substantially equal to the first target radius, and pressurizing the liquid to a pressure substantially equal to the second target pressure and manipulating the pipe to form a second bend having a radius substantially equal to the second target radius.

In accordance with a further aspect of at least one of the inventions disclosed herein, a method of forming a bend in a pipe is provided. The method includes determining a target angle of curvature of the bend, sealing an interior space of the pipe at a desired location of the bend, filling the interior space with a liquid, calculating an initial target pressure of the liquid as a function of the target angle wherein the initial target pressure is directly related to the target angle. The method also includes pressurizing the liquid to a pressure substantially equal to the initial target pressure, and increasing the pressure of the liquid from the initial target pressure while manipulating the pipe to form a bend having an angle substantially equal to the target angle.

In accordance with another aspect of at least one of the inventions disclosed herein, a system for forming a bend in a pipe at a bending position comprises a bending assembly including a pipe bending mechanism and a pressurizing mechanism. The system further comprises a memory and a controller. The pipe bending mechanism includes a first roll die having a first radius and a second roll die having a second radius smaller than the first radius and is configured to bend the pipe against a selected one of the first roll die and the second roll die. The bending assembly is configured to position the bending position of the pipe relative to the selected one of the first roll die and the second roll die. The pressurizing mechanism is configured to pressurize a liquid within a sealed interior space of the pipe including the bending position. The memory is configured to store a data set for the bend, wherein the data set comprises a target liquid pressure, a selection of one of the first roll die and the second roll die, and a bending position of the pipe. The controller is configured to process the data set to operate the pressurizing mechanism to pressurize the liquid to a pressure substantially equal to the target pressure and operate the pipe bending mechanism to bend the pipe at the bending position utilizing the selected one of the first roll die and the second roll die, wherein the target liquid pressure is greater for the second roll die than for the first roll die.

Another aspect of at least one of the inventions disclosed herein includes the realization that if a workpiece is disposed such that a liquid inlet end is disposed below a liquid outlet end while it is filled with a liquid, it is easier and faster to remove the air from inside the workpiece, thereby enhancing the speed of the manufacturing process which uses a pressurized liquid to affect a shape of an inner surface of a workpiece.

Accordingly a pipe bending method includes filling a workpiece with liquid, and pressurizing the liquid to a predetermined pressure level during the bending. Preferably, the pressure level is inversely proportional to the radius of the bend in the exhaust pipe. Accordingly, when the radius of the bend is large, the pressure level is lower than when the radius of the bend is smaller. Furthermore, preferably the pressure is proportional to the bending angle of the pipe. Thus, the pressure of the liquid increases as the angle of the bend increases. Optionally, the pressure level can be altered during the bending process. For example, the pressure level can be increased as the pipe is bent.

BRIEF DESCRIPTION OF THE DRAWINGS

These and other features, aspects and advantages of the present inventions will now be described with reference to drawings of preferred embodiments, which are intended to illustrate, but not to limit, the present inventions. The drawings contain sixteen figures.

DETAILED DESCRIPTION OF THE PREFERRED EMBODIMENTS

Figure 1:
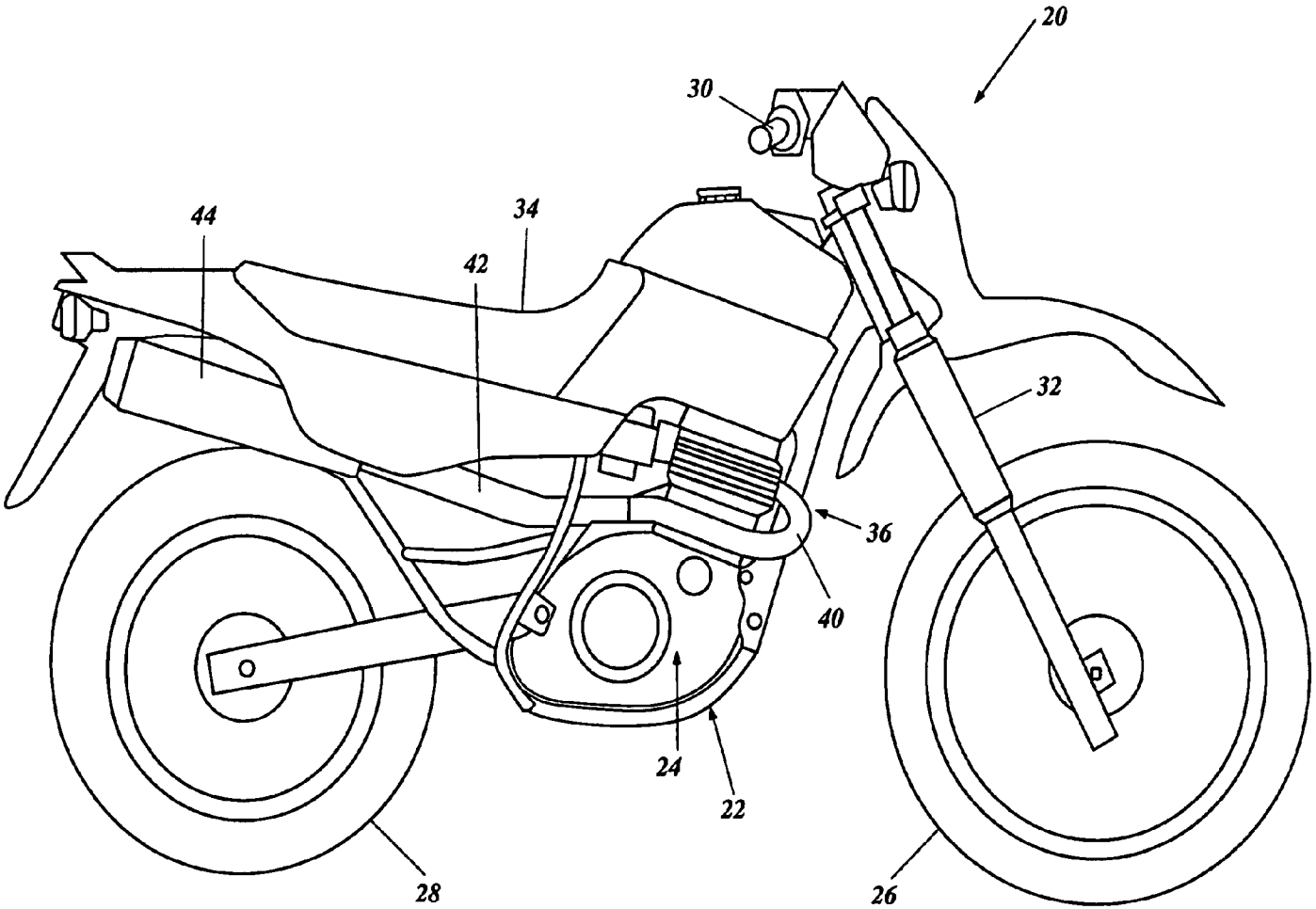
FIG. 1 is a side elevational view of a motorcycle incorporating an exhaust pipe produced by a preferred pipe bending apparatus constructed in accordance with at least one of the inventions disclosed herein.

FIG. 1 illustrates a motorcycle 20 incorporating a preferred exhaust system. The motorcycle 20 is described in general detail in order to assist the reader's understanding of a preferred environment of use of the inventions disclosed herein.

The motorcycle 20 includes a frame 22, which supports an internal combustion engine 24 therein. Front and rear wheels 26, 28, respectively, are supported relative to the frame 22.

A handlebar assembly 30 is coupled to the front wheel 26 through a front fork assembly 32. The handlebar assembly 30 permits a rider of the motorcycle 20 to turn the front wheel 26 about a steering axis. The frame 22 also supports a seat assembly 34, which supports a rider of the motorcycle.

The engine 24 includes an exhaust system 36 to guide exhaust gases from a combustion chamber (not shown) of the engine 24 to the atmosphere. Preferably, the exhaust system 36 includes an exhaust pipe 40 extending from the engine 24 to a secondary exhaust pipe 42. The secondary exhaust pipe 42 is connected to a muffler 44, which opens to the atmosphere.

The exhaust pipe 40, preferably, is manipulated into a curvilinear shape to conform to an available space adjacent the engine 24. That is, preferably, the exhaust pipe 40 is configured to nest compactly next to the engine 24 and frame 22 of the motorcycle so as to be protected from damage and avoid interfering with the legs of a rider of the motorcycle 20.

Figure 2A:
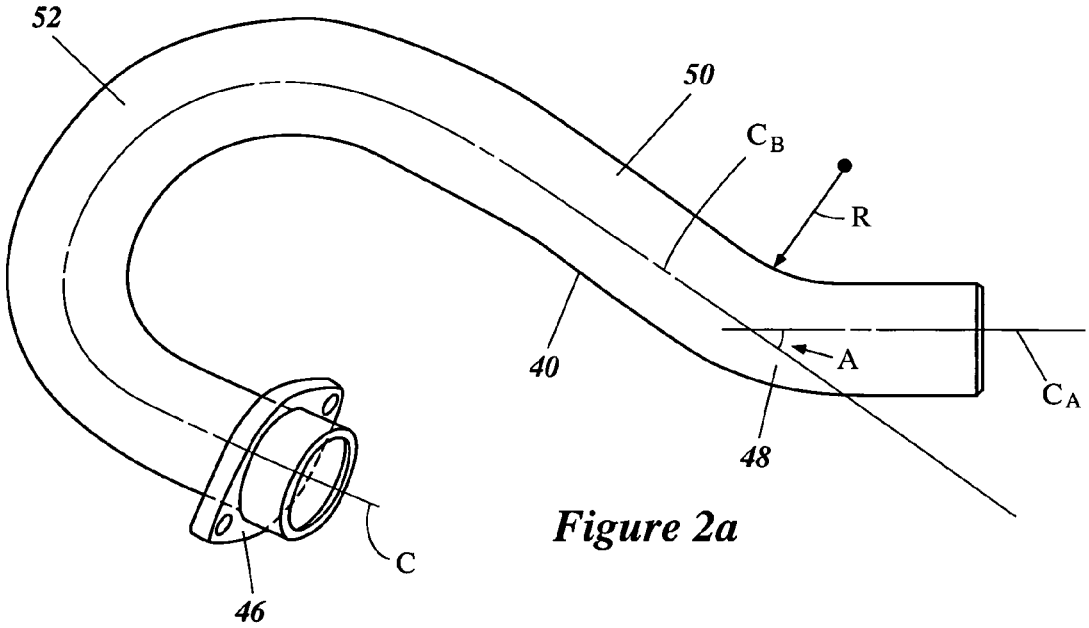
FIG. 2*a* is a top plan view of the exhaust pipe of FIG. 1 separated from the motorcycle of FIG. 1.
Figure 2B:
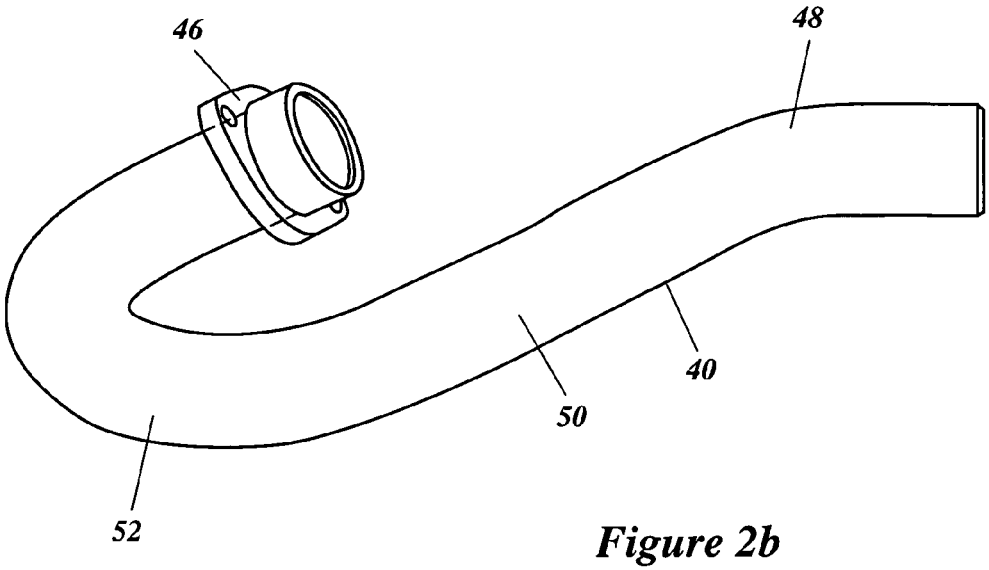
FIG. 2*b* is a left side elevational view of the exhaust pipe of FIG. 2*a*.

With reference to FIGS. 2*a* and 2*b*, the exhaust pipe 40 is shown removed from the motorcycle 20. A forward end of the exhaust pipe 40 includes a flange 46, which permits the exhaust pipe 40 to be connected to the engine 24. Arranged from a rearward end toward a forward end (i.e., opposite the direction of exhaust flow), the exhaust pipe 40 includes a first bent portion 48 defining a first bend, a second bent portion 50 defining a second bend, and a third bent portion 52 defining a third bend. Preferably, the exhaust pipe 40 is manufactured from a substantially linear, tubular piece of material, which is generally circular in cross-section.

As used herein, the term "radius of curvature" refers to the severity of a bend. For example, but without limitation, the arrow R of FIG. 2*a* identifies a radius of curvature of the first bent portion 48. The radius R is measured relative to the outer surface of the pipe 40 which defines the inner-most portion of the bent portion 48. However, the radius of curvature can be measured relative to any portion of the pipe 40, such as, for example, but without limitation, the outer-most surface, or the central axis C of the pipe 40.

Additionally, the term "angle of curvature" or "bending angle" refers to the angle through which a bend extends. An angle of curvature can be expressed as an angle A between a portion of the central axis $C_B$ before a bend, such as the bend 48, relative to a portion of the central axis $C_A$ after the bend 48.

Figure 3:
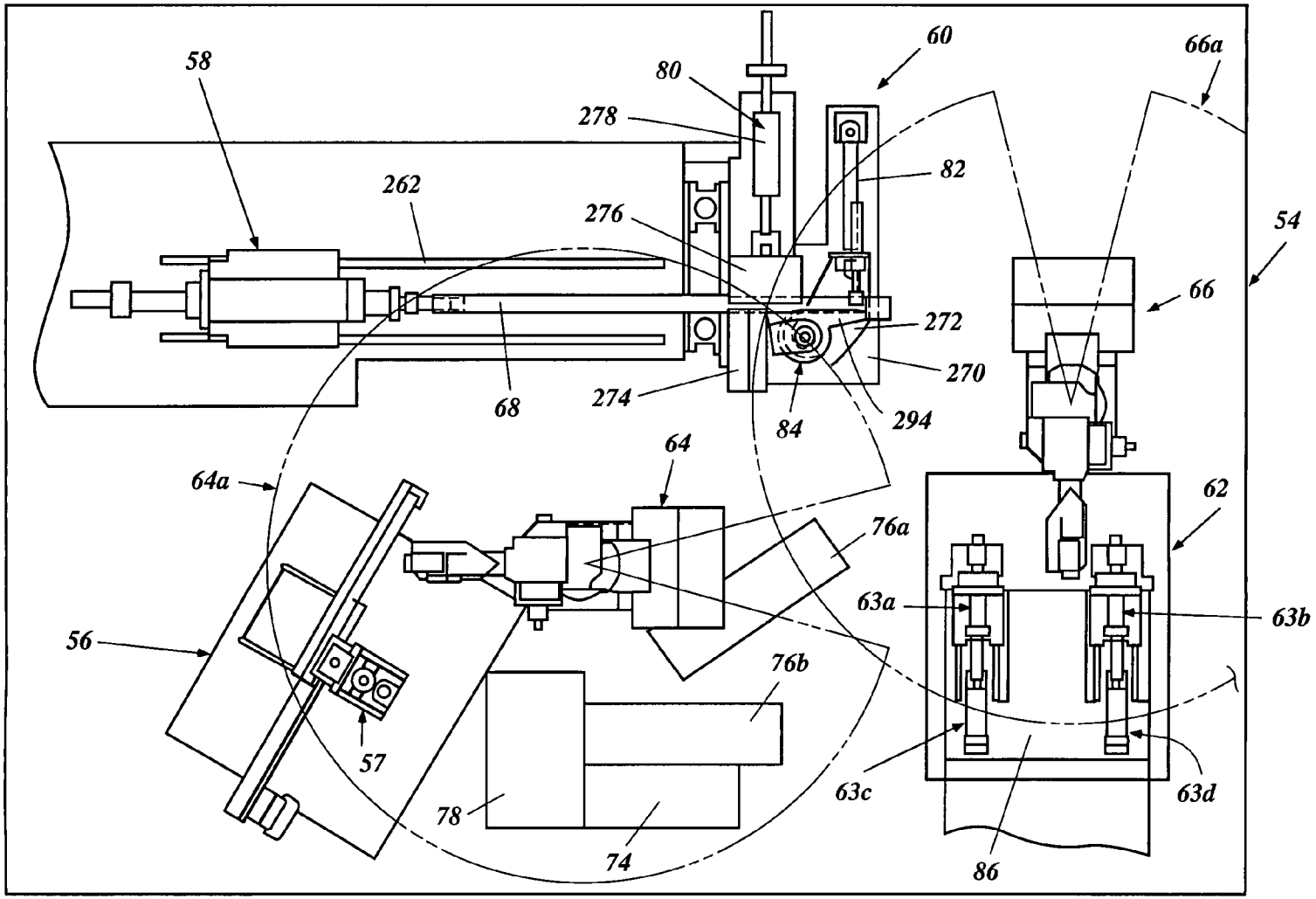
FIG. 3 is a plan view of a preferred pipe bending system, including a plugging device, a liquid pressurizing device, a bending device, and unplugging device.

Desirably, the bent portions 48, 50, 52 of the exhaust pipe 40 are created by a pipe bending system 54, described with reference to FIGS. 3–11. With reference to FIG. 3, the pipe bending system 54 desirably includes several subsystems and/or mechanisms for performing various procedures.

Preferably, the pipe bending system 54 includes a pipe fill mechanism 56, a bending subsystem including a pressurization mechanism 58 and a bending mechanism 60, and a pipe emptying mechanism 62. Desirably, the pipe bending system 54 also includes at least a first material handling device, such as first robot 64. FIG. 3 schematically illustrates the reach 64*a* of the first robot 64 in phantom line. In other words, the first robot 64 can reach any point within the perimeter defined by the line 64*a*. In the illustrative embodiment, the first robot 64 can reach objects disposed at certain portions of the pipe fill mechanism 56 and the pressurization mechanism 58.

In the illustrated embodiment, the pipe bending system 54 also includes a second material handling device, such as robot 66. The reach of the second robot 66 is illustrated schematically in FIG. 3 by the perimeter 66*a* shown in phantom. As such, the second robot 66 can reach objects disposed at certain portions of the bending mechanism 60, the pipe emptying mechanism 62, and the pipe fill mechanism 56. Together, the first and second robots 64, 66 cooperate to move work in process, or workpieces, and other materials between the individual stations 56, 58, 60, 62. As such, the first and second robots 64, 66 further enhance the speed at which the pipe bending system 54 can operate by enhancing the ability of the pipe bending system 54 to perform different operations on multiple workpieces in parallel.

The pipe bending system 54 is also configured to bend a workpiece, such as, for example, but without limitation, the workpiece 68 (FIG. 4) into the bent configuration of the final exhaust pipe 40 shown in FIGS. 2*a* and 2*b*, while maintaining and/or adjusting a liquid pressure within the workpiece 68. The pipe bending system 54 maintains end or adjusts the liquid pressure within the workpiece with sealing devices configured to form watertight seals at the ends of the workpiece 68. For example, but without limitation, the pipe bending system 54 can be configured to use first and second plugs 70, 72, described below in greater detail of reference to FIGS. 4, 7, and 8, to create watertight seals at the ends of the workpiece 68. Of course, the pipe bending system 54 can also be configured to bend other workpieces into other shapes.

Preferably, the pipe fill mechanism 56 includes a workpiece staging area 74, a used plug receiving area 76*a*, a plug staging area 76*b*, and a scrap storage area 78. The workpiece staging area 74 is configured to receive a supply of workpieces 68 which are manipulated by the pipe bending system 54 to form the finished exhaust pipe 40.

The used to plug receiving area 76*a* is configured to receive sealing devices, such as, for example, but without limitation, the plugs 70, 72 that have been used in a previous bending operation. As schematically illustrated in FIG. 3, one end of the used plug receiving area 76*a* is outside the periphery 64*a*. Thus, the used plug receiving area 76*a* is preferably configured to transport sealing devices to a position within the periphery 64*a*, so as to allow the robot 64 to reach the sealing devices disposed thereon. For example, a conveyor belt (not shown) or other type of transport mechanism can be configured to transport the sealing devices along the used plug receiving area 76*a*.

The plug staging area 76 is configured to receive new plugs 70, 72 or plugs 70, 72 that have been removed from a previously bent workpiece 68 for subsequent reuse at the pipe fill mechanism 56. The scrap storage area 78 is configured to receive defective workpieces 68 that can be produced by the system 54.

The pipe fill mechanism 56 preferably is configured to fit first and second plugs 70, 72 into first and second ends 68*a*, 68*b* of the workpiece 68. The plugs 70, 72 are configured to seal the first and second ends 68*a*, 68*b* of the workpiece 68 to form a watertight chamber therein.

The pipe fill mechanism 56 is also configured to fill the interior of the workpiece 68 with a liquid, such as, for example, but without limitation, water. Additionally, the pipe fill mechanism 56 is also configured to purge air from the liquid within the interior of the workpiece 68, and to discharge such air to an exterior of the workpiece 68.

The pipe fill mechanism 56 is further configured to hold the workpiece 68 in a position of such that an inlet end of the workpiece 68 is below the outlet end of the workpieces 68. As such, further advantages are provided in that air is more easily purged from the interior of the workpiece 68.

A further advantage is provided where the pipe fill mechanism 56 is configured to hold the workpiece 68 substantially vertically during the pipe fill process. As such, air is more quickly and easily purged from the interior of the workpiece 68.

The pressurization mechanism 58 is configured to receive a workpiece, such as the workpiece 68 having a liquid sealed therein with the first and second plugs 70, 72. Additionally, the pressurization mechanism 58 is configured to pressurize the liquid therein to a predetermined pressure level, and to allow the workpiece 68 to be manipulated while the liquid remains pressurized by the pressurization mechanism 58. A further advantage is provided where the pressurization mechanism 58 is configured to adjust the pressure level within the workpiece 68 during a bending operation.

Desirably, the bending mechanism 60 is figured to operate in parallel with the pressurization mechanism 58 such that the liquid pressure within the workpiece 68 can be maintained during the bending process. Additionally, as noted above, a further damage is provided where the pressure within the workpiece 68 can be adjusted during the bending process.

In addition, the illustrated pressurization mechanism 58 is configured to allow the workpiece 68 to be moved relative to the bending mechanism 60 in both translation and rotation to position the workpiece 68 in a suitable position relative to the bending mechanism 60 to permit the creation of one or more bends at one or more desired locations of the workpiece 68. In the illustrated embodiment, the pressurization mechanism 58 is configured to impart the rotational and translational forces upon the workpiece 68 to provide the corresponding rotational and translational movements of the workpiece 68 while maintaining and/or adjusting the liquid pressure within the workpiece 68.

The bending mechanism 60 preferably includes a clamp 80 configured to hold the workpiece 68 during the bending process. The bending mechanism 60 also includes a bending actuator 82, or cylinder, configured to exert an external force on the workpiece 68 to bend the workpiece 68 about a roll die assembly 84 to create at least one of the bent portions 48, 50, 52 of the finished exhaust pipe 40.

The pipe emptying mechanism 62 is configured to receive bent workpieces 68 from the pipe bending mechanism 60 and remove the first and second plugs 70, 72 from the first and second ends 68*a*, 68*b* of the workpiece 68. Desirably, finished workpieces 68 are placed in a finished material storage area, or chute 86, to be removed from the pipe bending system 54.

In the illustrated embodiment, the pipe emptying mechanism 62 includes first and second clamping devices 63*a*,63*b*. The first and second clamping devices 63*a*,63*b* are configured to clamp ends of a workpiece that has been bent. For example, but without limitation, the first and second clamping devices 63*a*,63*b* are configured to clamp the first and second plugs 70,72 after the workpiece 68 has been bent.

The pipe emptying mechanism 62 can also include disengagement devices 63*c*,63*d* configured to disengage the plugs 70,72 from the workpiece 68. In the illustrated embodiment, the disengagement devices 63*c*,63*d* are configured to loosen the nuts 184,186 of the plugs 70,72, described in greater detail below with reference to FIG. 8. An exemplary method of operating the pipe and emptying mechanism 62 is disclosed in greater detail below with reference to FIG. 12.

Figure 4:
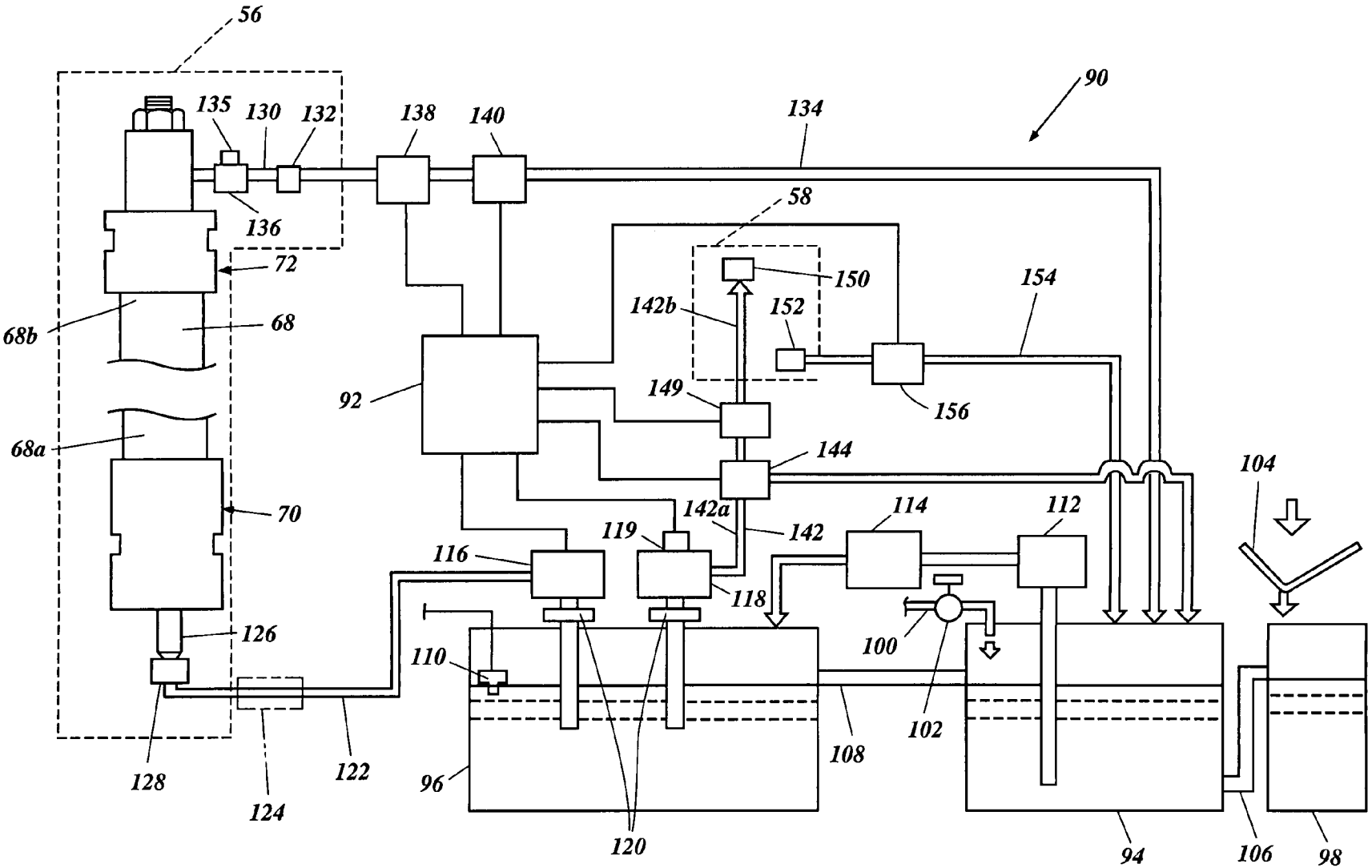
FIG. 4 is a schematic view of a liquid circulating system of the pipe bending system of FIG. 3.
Figure 5:
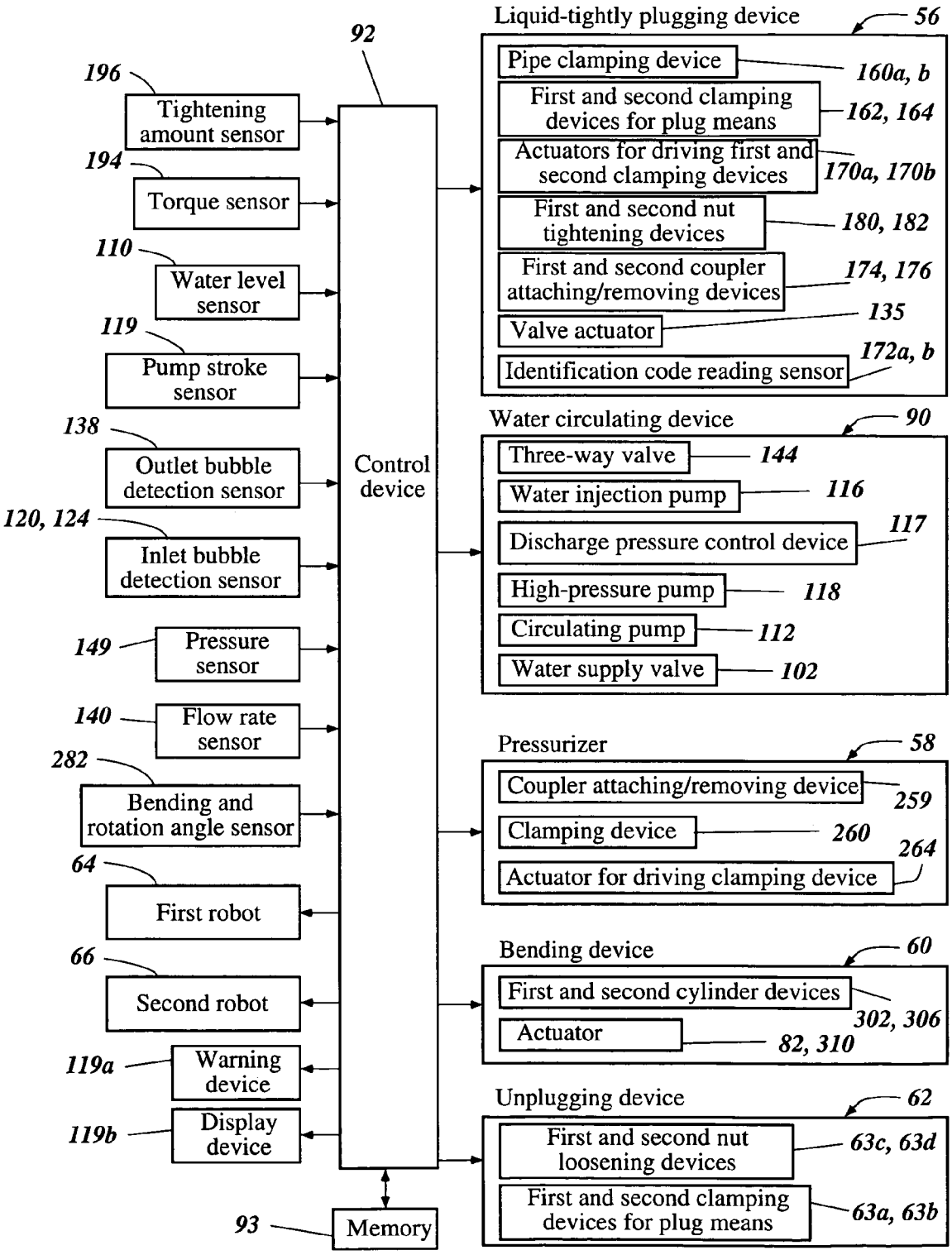
FIG. 5 is a schematic illustration of a control system of the pipe bending system of FIG. 3.

With reference to FIGS. 4 and 5, the pipe bending system 54 further includes a water circulation system 90 to supply water to subsystems of the bending system 54, such as the pipe fill mechanism 56 and the pressurization mechanism 58. The bending system 54 also includes a controller 92 that communicates with the various components of the bending system 54, including the stations 56, 58, 60, 62, the water circulating system 90, the robots 64, 66, and various sensors described in greater detail below.

Desirably, the controller 92 includes a memory 93 for storing a data set of parameters related to the bending process. For example, preferably, the memory 93 stores a data set for each desired bend including a target liquid pressure, a selection of one of the roll dies of the roll die assembly 84 if appropriate, and a longitudinal bending position of the workpiece 68. In the data sets for subsequent bends, preferably the memory 93 also stores a rotational bending position relative to the initial bend, as is described in greater detail below. The memory 93 can comprise any suitable type of construction for storing the above-described, or other process parameters.

Preferably, the water circulating system 90 includes several liquid holding tanks for storing liquid used by the pipe bending system 54. Preferably, the liquid used in the bending system 54 is water that can be supplied in a conventional method, such as through a municipal water supply.

Preferably, the water storage tanks include a first tank 94, a second tank 96, and a sedimentation tank 98. A supply pipe 100 is configured to supply water to the first tank 94. A supply valve 102 controls the supply of water from the pipe 100 to the first tank 94. The first tank 94 is in fluid communication with both the second tank 96 and the sedimentation tank 98.

The sedimentation tank 98 receives used water from the pipe emptying mechanism 62 via a water collector 104. Desirably, the sedimentation tank 98 communicates with the first tank 94 through a conduit 106. The sedimentation tank 98 is configured to separate particulate matter from the water received from the pipe emptying mechanism 62 and supply only water to the first tank 92. If desired, additional filtering methods or devices can also be used to treat water supplied by the sedimentation tank 98 to the first tank 94.

The first tank 94 and the second tank 96 communicate with one another through a conduit 108. The conduit 108 is configured such that the water level within the first and second tank 94, 96 is equalized.

The second tank 96 includes a water level sensor 110 configured to detect a level of the water within the second tank 96. When a low water level is sensed, the control device 92 opens the water supply valve 102 to supply water to the first tank 94 through the water supply pipe 100. Water can then flow from the first tank 94 through the conduit 108 to the second tank 96. In addition, the water circulation system 90 preferably also includes a circulation pump 112 configured to pump water from the first tank 94, through a suitable filter 114 to the second tank 96.

Preferably, a water injection pump 116 and a high pressure pump 118 are provided to pump water from the second tank 96 to the water fill mechanism 56 and the pressurization mechanism 58, respectively. Preferably, each of the pumps 116, 118 include an air detection sensor 120, which is configured to detect air bubbles within the water drawn from the second tank 96 by the pumps 116, 118. Thus, the air detection sensors are configured to indicate to the system 54 when air is present within the water supplied to the pumps 116, 118 which can indicate a low water level within the second tank 96 or a malfunction of the pumps 116, 118.

The high pressure pump 118 can be in the form of an air-driven plunger pump. In this embodiment, the pump 118 is driven and thus controlled by an air-pressure control device 117 (schematically shown in FIG. 5). The air pressure control device 117 can be controlled so as to change the air pressure discharged from the device 117 to the pump 118. As such, the output pressure of the pump 118 is changed in accordance with the air pressure provided to the pump 118 by the control device 117.

As shown in FIG. 5, the control device 117 is connected to the control device 92. Thus, the control device 92 can be configured to control the output pressure of the pump 118 by controlling the pressure of the air output from the device 117.

Desirably, the high pressure pump 118 is provided with a stroke sensor 119 in communication with the controller 92. The stroke sensor 119 is configured to sense a stroke speed of the high pressure pump 118 and provide a control signal to the controller 92 indicative of the stroke speed.

Additionally, the water circulating system 90 can include a pressure sensor configured to detect a pressure indicative of the pressure produced by the high pressure pump 118. The pressure sensor can be connected to the controller so that the controller 92 can monitor the pressure output by the high pressure pump 118. For example, the controller 92 can use the pressure detected by the sensor to control the high pressure pump 118 in accordance with a feedback loop principle of operation, so as to maintain a desired pressure at a point downstream from the pump 118. In the illustrated embodiment, the circulation system includes a pressure sensor 149, the operation of which is described in greater detail below.

In operation, if a crack occurs in the workpiece 68 or if the sealing of the plugs 70 or 72 fails, the pressure initially rapidly decreases. The speed of the high pressure pump 118 thus increases in accordance with a feedback control scenario used to maintain the water pressure. The speed of the high pressure pump 118 can be detected by the pump stroke sensor 119. Thus, the pump stroke sensor 119 can be used to detect an increase in pump speed that is indicative of a crack in the workpiece 68.

In the illustrated arrangement, the controller 92 is configured such that when the pressure decreases without a corresponding decrease in the pump stroke speed or when the pressure doesn't exceed a prescribed pressure for a given pump stroke speed, the controller 92 stops the high pressure pump 118, activates a warning device 119*a*, and displays the details of the abnormality on a display device 119*b* (FIG. 5). The warning device 119*a* can include a red revolving light to provide warning to workers working in the area.

The water injection pump 116 supplies water from the second tank 96 to the water fill mechanism 56 to fill the interior of the workpiece 68 with water. Specifically, the water injection pump 116 provides water to the water fill mechanism 56 through a water injection conduit 122, which optionally can include an air detection sensor 124 in the place of, or in addition to, the air sensor 120 of the injection pump 116.

The first plug 70 includes a coupler 126 which is configured to be removably connected to a coupler 128 of the water injection conduit 122. The first plug 70 and coupler 126 are configured to permit water to be introduced to the interior of the workpiece 68. Thus, water is supplied by the water injection pump 116 from the second tank 96 to the interior of the workpiece 68.

The second plug 72 also includes a coupler 130 which is configured to be removably connectable to a coupler 132 of a water discharge pipe 134. The water discharge pipe 134 extends to the first tank 94. The second plug 72 and coupler 130 are configured to permit communication with the interior of the workpiece 68.

A valve 136 is configured to selectively permit communication between the interior of the workpiece 68 and the water discharge pipe 134. In the illustrated embodiment, an actuator 135 is configured to operate the valve 136. Preferably, the actuator is controlled by the controller 92 (FIG. 5). Thus, as the interior of the pipe 68 is filled with water provided by the injection pump 116 from the second tank 96, air within the workpiece 68 is evacuated through the second plug 76 and water discharge pipe 134. Preferably, substantially all the air within the workpiece 68 is removed through the pipe 134.

The water discharge pipe 134 can include an air detector 138, similar to the air detection sensor 120 or 124 described above. The air detection sensor 138 can be configured to detect air within the water discharge pipe 134 to inform the system 54 when the workpiece 68 has been filled with water. That is, due to the vertical orientation of the workpiece 68, air is evacuated out of the workpiece 68 as a result from water entering the interior of the workpiece 68 through its lower end. Once the air detection sensor 138 detects that no air is present within the water discharge pipe 134, the controller 92 determines that the workpiece 68 has been filled with water.

The water discharge pipe 134 can also include a flow rate sensor 140 configured to detect a volumetric flow rate of water through the water discharge pipe 134. The flow rate sensor 140 can be used by the system 54 to control the supply of water through the water injection conduit 122 into the workpiece 68 based on a flow rate detected by the flow rate sensor 140 over a predetermined period of time based on the volume within the workpiece 68.

As described above, the high pressure pump 118 communicates with the pressurization mechanism 58. Preferably, the high pressure pump 118 communicates with the pressurization mechanism 58 through a supply conduit 142. The supply conduit 142 can include a valve 144, configured to divide the supply conduit 142 into an upstream end 142*a* and a downstream end 142*b*. The valve 144 is configured to selectively permit the upstream portion 142*a* of the supply conduit 142 to communicate with either the downstream portion 142*b* of the supply conduit, which communicates with the pressurization mechanism 58, or a bypass conduit 146, which returns water to the first tank 94 when additional pressurization of the water within the workpiece 68 is not needed during the bending process.

The downstream portion 142*b* of the supply conduit 142 includes a coupler 150, which is configured to be selectively connectable with the coupler 126 of the first plug 70 or a coupler 152 of a water discharge conduit 154. The water discharge conduit 154 is configured to return water to the first tank 94. Desirably, the coupler 150 includes a check valve arrangement which permits fluid to exit the downstream portion 142*b* of the supply conduit 142, but inhibits air from entering the downstream portion 142*b*.

The water discharge conduit 154 desirably includes an air detection sensor 156, which can be similar to the air detection sensors 120, 124 or 138. The air detection sensor 156 is configured to detect the presence of air within the water discharge conduit 154. Thus, the coupler 150 of the downstream portion 142*b* of the supply conduit 142 can be coupled to the air discharge coupler 152 such that water supplied by the high pressure pump 118 passes through the water discharge conduit 154 and into the first tank 94, thereby removing air present within the downstream portion 142*b* of the supply conduit 142. The air detection sensor 156 permits the system 54 to detect when air is no longer present within the water flowing through the discharge conduit 154.

Once the downstream portion 142*b* of the supply conduit 142 has been primed, the coupler 150 can be connected to the coupler 126 of the first plug 70 to permit communication between the supply conduit 142 and the interior of the workpiece, 68. Thus, the high pressure pump 118 can then pressurize liquid within the workpiece 68 to a desired pressure level.

Figure 6:
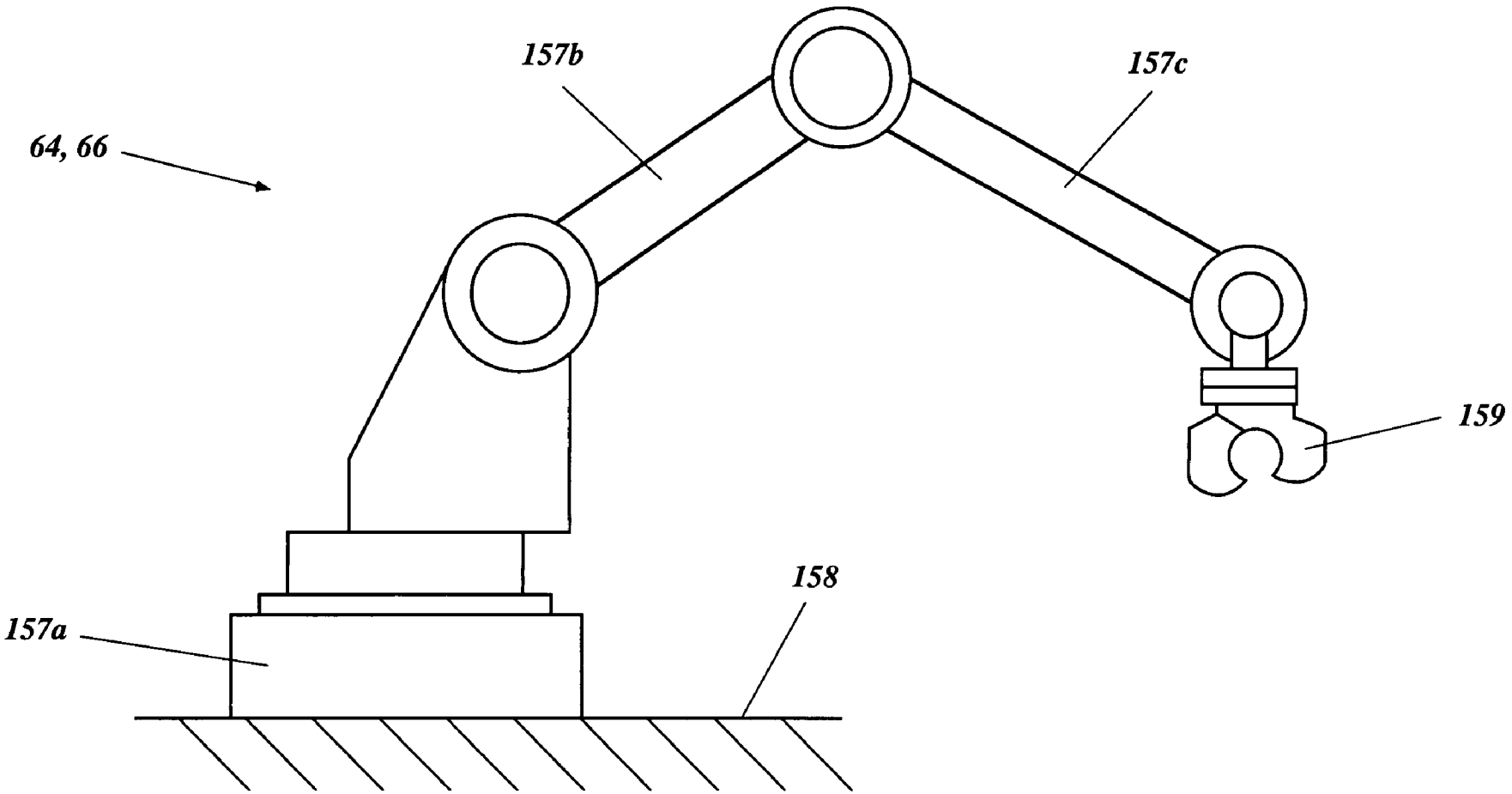
FIG. 6 is a side elevational view of a preferred material handling robot arm of the pipe bending system of FIG. 3.

With reference to FIG. 6, each robot 64, 66 can be supported by a base 157*a*, which supports the robot 64, 66 on a surface, such as a floor 158. Each robot 64, 66 can include an arm having a first arm portion 157*b* extending from the base 157*a* and a second arm portion 157*c* extending from the first arm portion 157*b*. A claw-type grip, or clamp 159, can be supported on the end of the second arm portion 157*c* opposite the first arm portion 157*b*. The clamp 159 is configured to grip the workpiece 68 so that the robot 64, 66 can move the workpiece 68 between the subsystems, or mechanisms, of the bending system 54.

Figure 7:
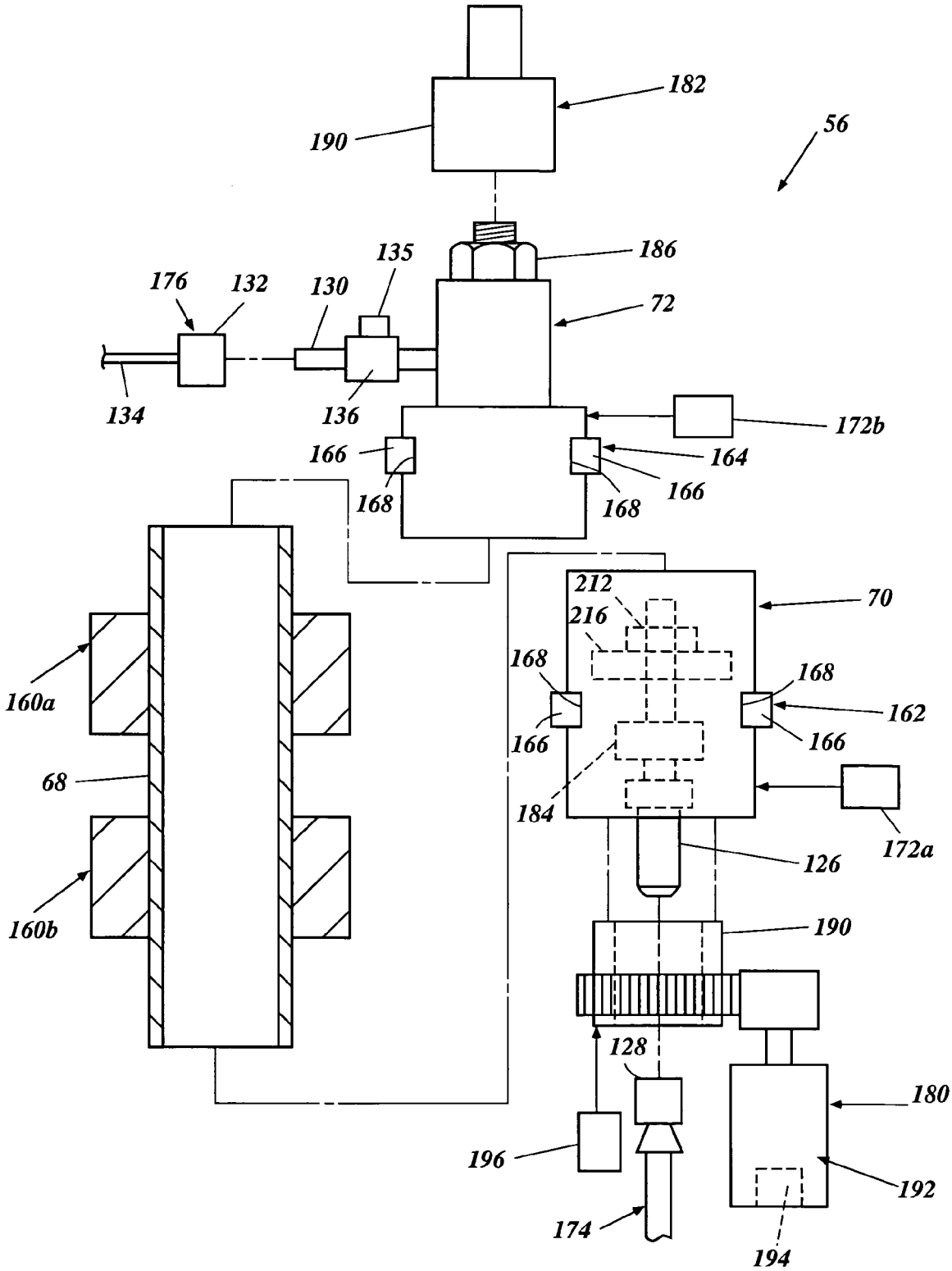
FIG. 7 is a schematic, partial cross-sectional view of the plugging device of the pipe bending system of FIG. 3.
Figure 8:
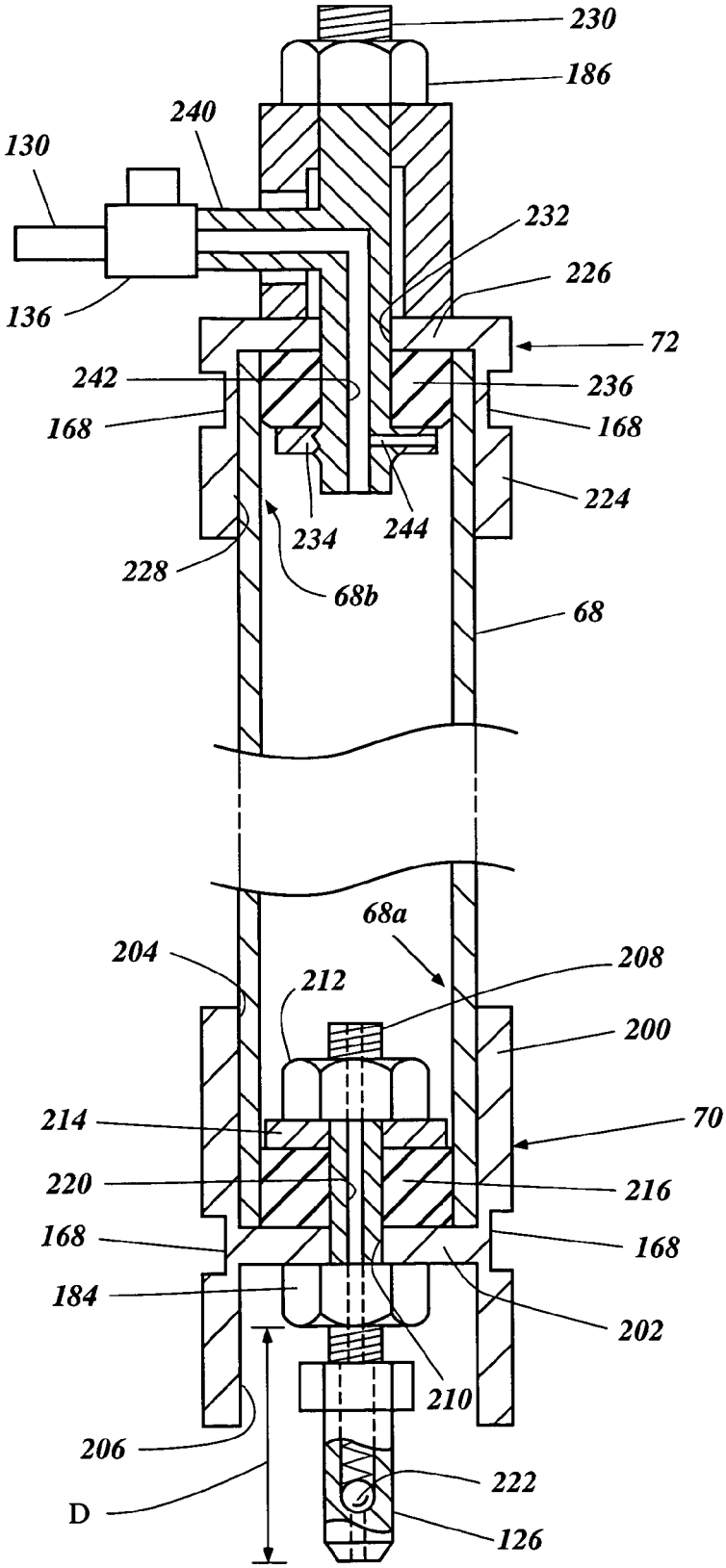
FIG. 8 is a cross-sectional view of a workpiece and first and second plugs of the plugging device of FIG. 7.

With reference to FIGS. 7 and 8, the pipe fill mechanism 56 is described in greater detail. As described above, preferably the pipe fill mechanism 56 is configured to apply the first and second plugs 70, 72 to the pipe, or workpiece 68, and fill the interior of the workpiece 68 with water.

A further advantage is provided where the workpiece 68 is disposed such that the outlet end is disposed above the inlet end. For example, in the illustrated embodiment, the second plug 72 is disposed above the first plug 70. Thus, as the liquid is introduced into the workpiece 68, air flows more easily out through the second plug 72. Thus, the workpiece 68 can be filled with liquid more quickly than when the workpiece is disposed such that the inlet and outlet ends are at approximately the same elevation.

An additional advantage is provided where the workpiece 68 is disposed generally vertically when it is filled with liquid. For example, with reference to FIG. 8, with the workpiece 68 disposed generally vertically, the air within the workpiece 68 flows more quickly out of the workpiece 68 as liquid is introduced. Additionally, if air bubbles aspirate out of the liquid after it is injected into the workpiece 68, such air bubbles will tend to float upwardly, towards the second plug 72, and thus can be more quickly purged out of the workpiece 68.

With continued reference to FIGS. 7 and 8, the pipe fill mechanism 56 can a pair of pipe clamps 160*a*, 160*b* configured to receive and secure the workpiece 68. In addition, the pipe fill mechanism 56 desirably includes a first clamp assembly 162 configured to selectively receive and hold the first plug 70 and a second clamp assembly 164 configured to receive and hold the second plug 72. Each of the first and second clamp assemblies 162, 164 desirably include a clamp member 166 configured to engage a groove 168 of the first and second plugs 70, 72, respectively. With reference to FIG. 5, desirably the pipe fill mechanism 56 additionally includes first and second actuators 170*a*, 170*b* configured to move the first and second clamp assemblies 162, 164, and thus the first and second plugs 70, 72 onto the first and second ends of the workpiece 68.

Desirably, each of the first and second plugs 70, 72 include an identifier, such as a barcode label, thereon. A reading device (sensors 172*a* and 172*b*) is associated with each of the first and second clamp assemblies 162, 164, respectively. The reading devices 172*a*, 172*b* are configured to read the identifier on the first and second plugs 70, 72 to verify that the correct plugs are being used for a given workpiece 68.

In addition, the pipe bending system 54 can include a counter configured to determine the number of times a plug, such as the plugs 70,72 have been used. This provides a further advantage because plugs, such as the plugs 70,72, can have a limited service life that can be defined in terms of the number of times that the plugs have been used. Each time a plug is used, the expander seal is compressed sufficiently to seal a high pressure liquid within the workpiece. Thus, the expanding seal, as well as other components, can suffer from the fatigue causes by the cyclic operation thereof. Thus, by including a counter configured to determine the number of times a plug is used, the system 54 can cause a plug to be replaced, thereby reducing the a likelihood that a plug will fail during operation.

In one embodiment, the control device 92 is configured to identify a plug each time such a plug is installed onto a workpiece, using a reading device, such as the sensors 172*a* and 172*b*. Additionally, the control device 92 can be configured to store data indicative of the number of times the identified plug is used. For example, the control device 92 can be configured to add one count to a data set, each time the plug is detected by one of the sensors 172*a* and 172*b*. The counted can be constructed in any known manner, including an electronic counter, a subroutine configured to count using the memory 93, or a mechanical counting device.

As noted above, the control device 92 can be configured to cause a plug to be replaced, based on the number of times such a plug is used. For example, the control device 92 can be configured to emit a visual or aural alarm when a plug is detected that has reached or exceeded a predetermined number of uses. Alternatively, the control device 92 can be configured to automatically discard the detected plug, and replace it with another. For example, the control device 92 can be configured to operate one of the robots 64,66, or another robot to remove the plug from the system 54 and to use another plug.

Desirably, the pipe fill mechanism 56 also includes first and second coupling devices 174, 176 configured to connect and remove the couplers 128, 132 to and from the couplers 126, 130, respectively. The first and second coupling devices 174, 176 can be of any suitable construction for selectively connecting or disconnecting the couplers 128, 132, as can be readily determined by one of skill in the art.

The illustrated fill mechanism 56 further includes first and second plug securing mechanisms 180, 182. The plug securing mechanisms 180, 182 selectively engage respective first and second nuts 184, 186 of the first and second plug 70, 72, respectively. The first and second nuts 184, 186 are operable to secure the first and second plug 70, 72 to first and second ends 68*a*, 68*b* of the workpiece 68, as is described in greater detail below.

The first plug securing mechanism 180 includes a socket 190 for engaging the nut 184 of the first plug 70. The socket 190 is rotatable by a motor 192. Thus, the motor 192 can be activated to rotate the socket 190 which, in turn, rotates the nut 184 to secure the first plug 70 within a first end 68*a* of the workpiece 68. Desirably, the motor 192 incorporates a torque sensor 194 configured to determine a torque on the nut 184. In addition, preferably, the plug securing mechanism 180 includes a distance sensor 196 configured to determine a relative position of the nut 184. Desirably, the torque sensor 194 and the distance sensor 196 are utilized in cooperation to determine a proper tightening of the nut 184 to achieve a secure seal between the first plug 70 and the workpiece 68 as well as malfunctions of the first plug 70, such as poor engagement of the nut 184 with the plug 70. Preferably, the second plug securing mechanism 182 is arranged substantially the same as the first plug securing mechanism 180.

With reference to FIG. 8, the first plug 70 can include a substantially cylindrical plug body 200. The plug body 200 preferably is hollow with the exception of a dividing wall 202, which extends transversely to the outer wall of the plug body 200. The divider wall 202 desirably is positioned in an intermediate region of the plug body 200 to separate the interior of the plug body 200 into first and second cavities 204, 206.

The first cavity 204 is configured to accept the first end 68*a* of the workpiece 68. Preferably, the first cavity 204 snugly receives the first end 68*a* of the workpiece 68. The second cavity 206 is configured to accommodate the nut 184 and coupler 126 of the first plug 70.

Preferably, the first plug 70 includes a shaft 208, which passes through an aperture 210 of the divider wall. The shaft 208 desirably includes external threads on both ends. The first threaded end of the shaft 208 receives the nut 184, as described previously, and the second, or internal, end of the shaft 208 receives a nut 212.

A plate 214 and a seal member 216 are positioned between the nut 212 and the divider wall 202 so as to be within the first end 68*a* of the workpiece 68 when the plug 70 is assembled thereto. The plate 214 is positioned adjacent the nut 212 so as to distribute a compression force provided by the nut 212 over an end surface of the seal member 216. Upon tightening of the nut 184, the seal member 216 is compressed and expands radially to create a seal with an interior surface of the workpiece 68. Preferably, the nut 184 is tightened a sufficient distance D relative to the shaft 208 to create a watertight seal between the seal member 216 and the workpiece 68.

As described above, the plug 70 includes a coupler 126, which is configured to permit fluid communication with the interior of the workpiece 68. Desirably, the shaft 208 includes an axial, internal passage 220 extending therethrough. As described above, the coupler 126 includes a check valve arrangement 222 configured to permit fluid to enter the interior space of the workpiece 68, and to prevent fluid from exiting through the coupler 126. Desirably, the check valve 222 is opened by an actuator of the coupler 128 of the injection pipe 122 or by an actuator of the pressurizing coupler 150, as described above with reference to FIG. 4.

The second plug 72 is also configured to create a fluid tight seal with the workpiece 68. The second plug 72 includes a generally cylindrical plug body 224 having an upper end closed by a transverse wall 226 thereby defining an interior cavity 228 configured to receive the second end 68*b* of the workpiece 68. The second plug 72 further includes a shaft 230 extending through an aperture 232 of the transverse wall 226. An upper end of the shaft 230 is threaded to accommodate the nut 186.

A plate 234 is secured to a lower end of the shaft 230. The lower end of the shaft can be externally threaded to accommodate internal threads of the plate 234 or the plate 234 can be secured to the shaft 230 by other suitable means. The nut 186 and plate 234 cooperate to apply a compressive force to a seal member 236 to seal the second end 68*b* of the workpiece 68 in the same manner as that described above in relation to the first plug 70.

The shaft 230 desirably includes a transverse extending portion 240 to which the valve 136 and the coupler 130 are connected, as described above with reference to FIGS. 4 and 7. The shaft 230 includes an internal passage 242 permitting communication between the valve 136 and the interior of the workpiece 68. In addition, preferably, the plate 234 includes a communication passage 244 extending from the passage 242 and opening at a peripheral edge of the plate 234. Thus, the communication passage 244 extends generally transverse to a longitudinal axis of the workpiece 68 and, desirably, is positioned near an upper end of the workpiece 68 when the workpiece is positioned within the pipe fill mechanism 56. Such a placement of the communication passage 244 facilitates the complete exit of air from the interior of the workpiece 68.

Figure 9:
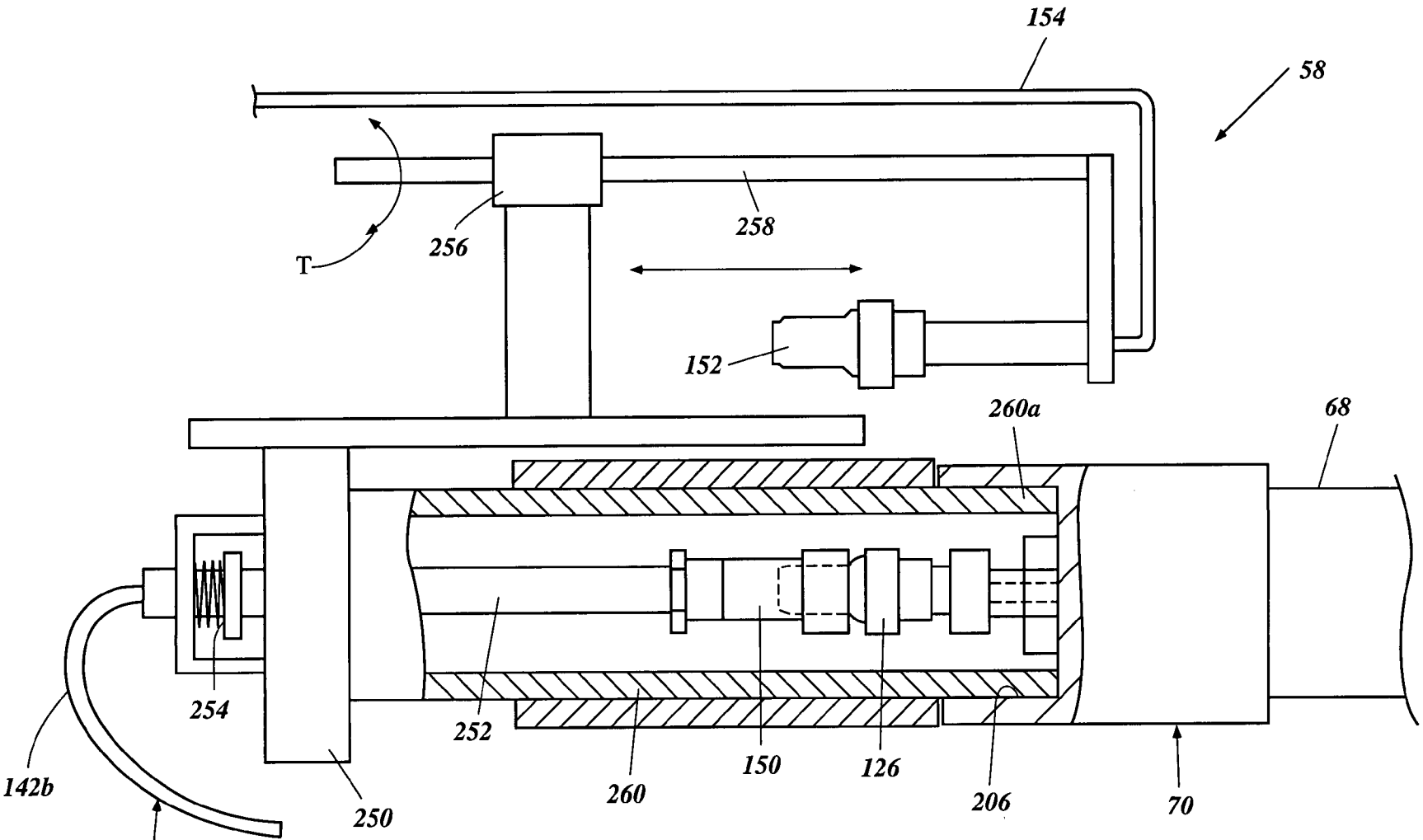
FIG. 9 is a side elevational, partial cross-sectional view of a pressurizing device of the pipe bending system of FIG. 3.

With reference to FIG. 9, the pressurization mechanism 58 is described in greater detail. As described above, the pressurization mechanism 58 is configured to pressurize the water within the workpiece 68 during the bending process. Furthermore, the pressurization mechanism 58 is configured to evacuate air from the downstream end 142*b* of the water supply conduit 142, as described above with reference to FIG. 4.

The pressurization mechanism 58 includes a frame 250 which supports a rod 252. The rod 252 supports the pressurizing coupler 150 (FIG. 4) and is mounted for limited translation relative to the frame 250.

A spring 254 is mounted between the frame 250 and the rod 252 to provide a cushioning effect to the rod 252 upon connection of the pressurizing coupler 150 with either of the coupler 126 of the first plug 70 or the coupler 152 of the discharged conduit 154. The downstream portion 142*b* of the supply conduit 142 passes through the rod 252 to the pressurizing coupler 150 to permit selective connection to either the coupler 126 or the coupler 152.

A support member 256 extends above the frame 250 and supports a support shaft 258. The support shaft 258 is permitted to rotate and translate relative to the support member 256 as indicated by the arrows T in FIG. 9. The support shaft 258 supports the coupler 152, which communicates with the discharge conduit 154, as described above with reference to FIG. 4. Thus, the support shaft 258 is operable to move the coupler 152 into connection with the pressurizing coupler 150 when no workpiece 68 is present in the pressurization mechanism 58. Preferably, the pressurization mechanism includes an actuator 259 (FIG. 5) configured to move the air discharge coupler 152 into connection with the pressurization coupler 150.

The pressurization mechanism 58 further includes a clamp 260, which is configured to selectively clamp the first plug 70. Desirably, the clamp 260 includes an end portion 260*a* which includes a plurality of longitudinal slots (not shown). The slots permit the end 260*a* to selectively expand in order to clamp the surface of the cavity 206 of the first plug.

With additional reference to FIG. 3, the frame 250, and thus the clamp 260, are movable relative to the bending mechanism 60 on rails 262. In addition, the clamp 65 is rotatable relative to the frame 250. The pressurization mechanism 58 includes an actuator 264 (FIG. 5) that is configured to move the frame 250 along the rails 262 and to rotate the clamp 260 relative to the frame 260. Thus, the actuator 264 is configured to move the workpiece 268 in both translation and rotation relative to the bending mechanism 60.

Figure 10:
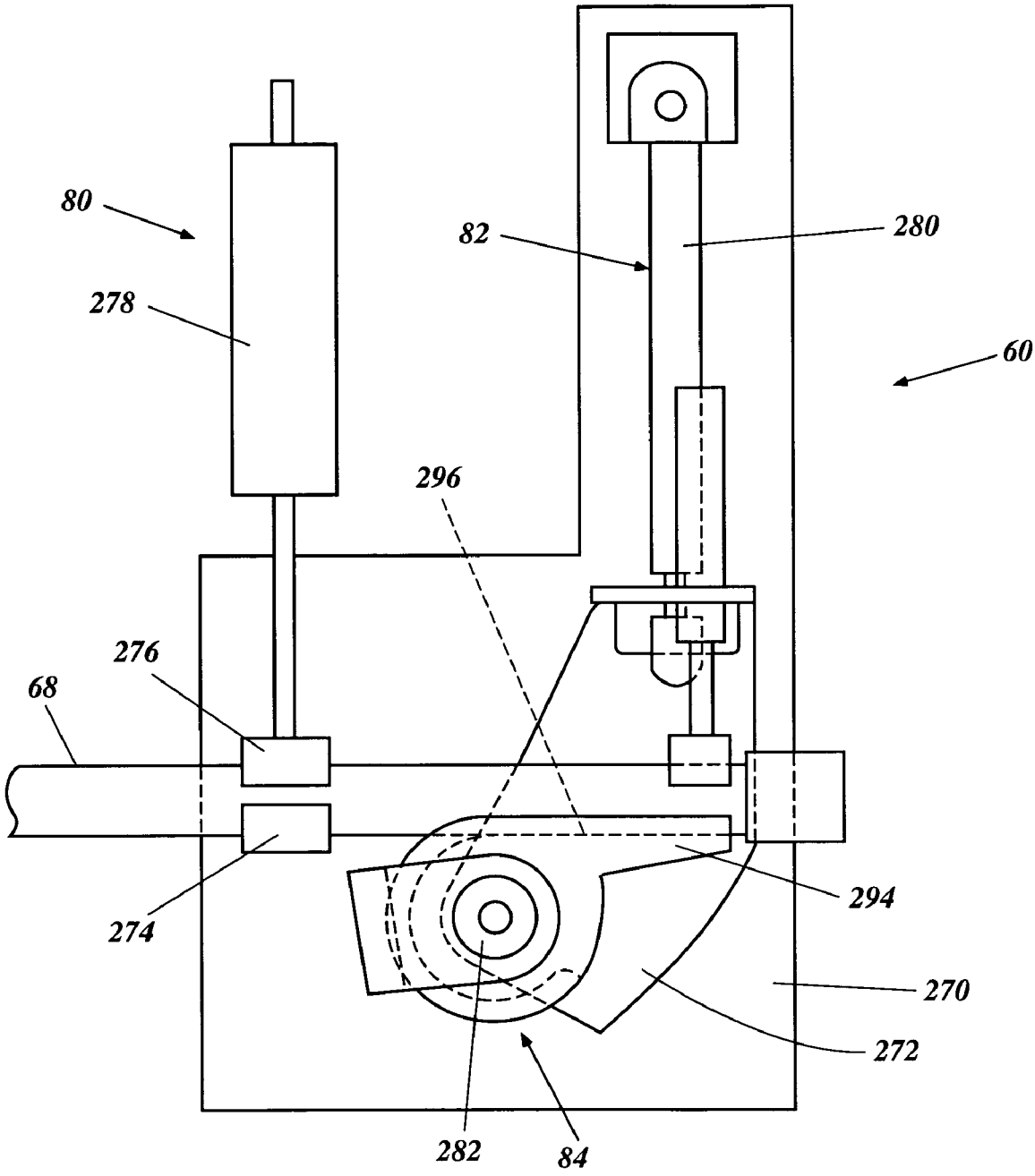
FIG. 10 is a top plan view of a bending device of the pipe bending system of FIG. 3.
Figure 11:
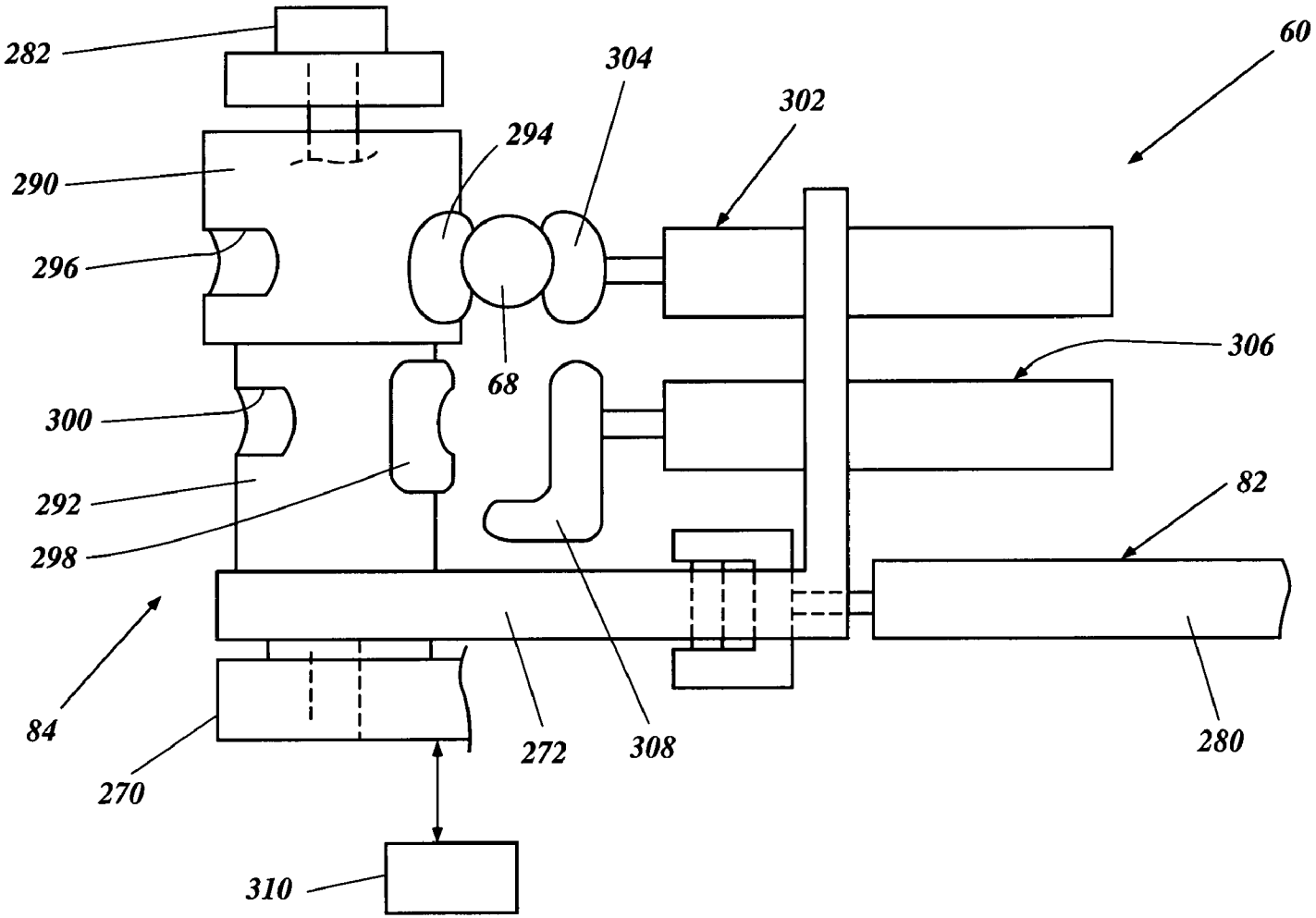
FIG. 11 is a side elevational view of the bending device of FIG. 10.

With reference to FIGS. 10 and 11, the bending mechanism 60 includes a holding device 80 to hold the workpiece 68 in a desired position relative to a roll die assembly 84. A bending actuator 82, or bending cylinder, is configured to apply an external force to an end of the workpiece 68 to bend the workpiece 68 about the roll die assembly 84 to create a bend in the workpiece 68.

Desirably, the bending mechanism 60 includes a base 270, which rotatably supports a support table 272 thereon. The roll die assembly 84 is supported for rotation along with the support table 272 about the same axis of rotation.

The pipe holding device 80 includes a first support member, or jig 274, a second support member or jig 276, and a pipe holding cylinder 278. The first jig 274 is fixed relative to the base 270 and the second jig 276 is movably supported by the pipe holding cylinder 278. The first and second jig 274, 276 cooperate to define an area for receiving the workpiece 68. The cylinder 278 urges the second jig 276 toward the first jig 274 to securely hold the workpiece 68 therebetween.

The bending actuator 82, includes a first end 280 that is rotatably supported relative to the base 270. A second end of the bending cylinder 82 is fixed to the support table 272. The bending actuator 82 can be a hydraulic cylinder configured to apply a force for rotating the support table 272 relative to the base 270. An angle sensor 282 is configured to determine an angular position of the support table 272 relative to the base 270. The sensor 280 is configured to communicate with the controller 92 so that the system 54 is apprised of the rotational position of the support table 272 relative to the base 270. As such, the controller 92 can control the actuation of the actuator 82 under a feedback loop principle of operation.

With reference to FIG. 11, the roll die assembly preferably includes a first roll die 290 and a second roll die 292. Each of the roll dies 290, 292 are generally cylindrical in shape and are mounted for rotation with the support table 272 with the roll die 290 being positioned above the second roll die 292. Preferably, the first roll die 290 is of a larger diameter than the second roll die 292. Accordingly, the first roll die 290 is utilized to produce a bend in the workpiece 68 having a larger radius of curvature than the second roll die 292.

The first roll die 290 includes a pipe support portion 294, which extends generally tangentially from an outer surface of the roll die 290. In addition, an outer surface of the first roll die 290 defines a semi-circular groove 296 around at least a portion of its circumference. The groove 296 is aligned with and extends onto an outer surface of the pipe support portion 294. Similarly, the second roll die 292 includes a generally tangentially extending pipe support portion 298 and a circumferential groove 300.

A first cylinder 302 is supported by the rotatable support table 272 in alignment with the first roll die 290. The first cylinder 302 is configured to apply an external force to the workpiece 68 with a support member 304. Thus, the support member 304 of the first cylinder 302 cooperates with the pipe support portion 294 and groove 296 of the first roll die 290 to maintain the workpiece 68 in contact with the first roll die 290 upon rotation of the support table 272. Accordingly, rotation of the support table 272 relative to the base 270 results in a bend of the workpiece 268 formed by the groove 296 of the roll die 290.

Similarly, a second cylinder 306 is supported by the support table 272 in alignment with the second roll die 292. The second cylinder 306 is configured to apply an external force to the workpiece 68 with a support member 308. Furthermore, the bending mechanism 60 includes an adjuster 310 to adjust a position of the support table 272 relative to the base 270 to selectively position either the first roll die 290 or the second roll die 292 into alignment with the workpiece 68. Thus, either of the first roll die 290 or the second roll die 292 can be utilized to create a bend of a desired diameter in the workpiece 68.

In operation, the pipe bending system 54 as described above is configured to produce one or more bends of one or more radii of curvature and angles of curvature in a linear, tubular workpiece 68. The system 54 is capable of creating bends in the workpiece 68 having a small degree of distortion in the cross-sectional area and/or cross-sectional shape of the workpiece 68 by maintaining and/or altering a pressure of the fluid within the workpiece with the radius of curvature and/or the angle of curvature.

Initially, the first robot 64 retrieves a workpiece 68 from the workpiece staging area 74 and delivers the workpiece to the pipe fill mechanism 56. The workpiece 68 is positioned vertically within the pipe fill mechanism 56 and is clamped by the first and second pipe clamps 160*a*, 160*b*. The first robot 64 retrieves the first and second plugs 70, 72 from the plug staging area 76 and delivers them to the pipe fill mechanism 56, where they are received by the first and second clamps 162, 164. The first and second plugs 70, 72 are secured onto the first and second ends 68*a*, 68*b* of the workpiece 68 and are sealed by the first and second plug securing mechanisms 180, 182. Thus, the interior of the workpiece 68 is sealed by the first and second plugs 70, 72.

Once the first and second plugs 70, 72 have been secured to the workpiece 68, the water supply coupler 128 is connected to the coupler 126 of the first plug 70 by the first coupler connecting device 174. Similarly, the discharge coupler 132 is connected to the coupler 130 of the second plug 72 by the second coupler connecting device 176.

Water from the second tank 96 is supplied by the injection pump 116 to the interior of the workpiece 68 through the injection conduit 122. The valve 136 of the second plug 72 is maintained in an open position so that once the interior of the workpiece 68 is filled, water flows through the discharge conduit 134 and returns to the first tank 94. Once the air detection sensor 138 determines that no air is present within the water passing through the water discharge conduit 134, the valve 136 is shut and water flow to the workpiece 68 is stopped.

Optionally, or additionally, the flow rate sensor 140 can be used to determine a flow rate through the water discharge conduit 134 and the controller 92 can stop the injection pump 116 once it has been determined that an amount of water sufficient to fill the interior of the workpiece 68 has been provided by the injection pump 116. Once the workpiece 68 has been filled with water, the supply coupler 128 and the discharge coupler 132 are removed from the first and second plugs 70, 72, respectively.

Preferably, before receiving the workpiece 68 the pressurization mechanism 58 performs an air discharge operation, as described above. Specifically, the support shaft 258 is translated and rotated relative to the support member 256 to position the coupler 152 of the water discharge conduit 154 to the pressurizing coupler 150. Water is supplied to the downstream end 142*b* of the pressurizing delivery conduit 142 until the air detection sensor 156 determines that no air is present in the water flowing through the discharge conduit 154. At that time, the high pressure pump 118 discontinues the delivery of water. The air discharge coupler 152 is then disconnected from the pressurizing coupler 150 and the support shaft 258 is rotated and translated relative to the support member 256 to move the coupler 152 into the position illustrated in FIG. 9 away from the pressurizing coupler 150. Alternatively, the air discharge operation can be performed only periodically.

The first robot 64 moves the filled workpiece 68 from the pipe fill mechanism 56 to the pressurization mechanism 58. The first plug 70 is connected to the clamp 260 of the pressurization mechanism 58 such that the coupler 126 of the first plug 70 is connected to the pressurizing coupler 150. The clamping actuator 264 actuates the clamp 260 to clamp the first plug 70 so that the workpiece 68 is secured to the pressurization mechanism 58. Preferably, after the workpiece 68 has been delivered to the pressurization mechanism 58, the first robot 64 loads an additional set of first and second plugs 70, 72 into the pipe fill mechanism 56 and delivers a new workpiece 68 to the pipe fill mechanism 56. That is, desirably while one workpiece is being pressurized and bent in the pressurization mechanism 58 and the bending mechanism 60, another workpiece 68 is being filled with water at the pipe fill mechanism 56.

Returning to the pressurization mechanism 58 and the bending mechanism 60, the workpiece 68 is clamped within the bending mechanism 60 by the pipe clamp device 80. After the workpiece 68 is secured within the pressurization mechanism 58 and clamped within the bending mechanism 60, the high pressure pump 118 is activated to increase the pressure of the water within the workpiece 68. Preferably, once the pressure within the workpiece 68 has reached approximately 90% of a predetermined target pressure, the pressure is gradually increased to the target pressure by feedback control from the pressure sensor 149 and the controller 92. Preferably, the pressure is raised to a pressure near the yield strength of the workpiece 68.

The height adjuster 310 is actuated to adjust a height of the support table 272 such that a desired one of the first roll die 296 and the second roll die 298 is aligned with the workpiece 68. The appropriate one of the first cylinder 302 and the second cylinder 306 is activated such that the workpiece 68 is clamped between the appropriate one of the first and second pipe support portions 294, 298 and the appropriate one of the pipe support portions 304 and 308 of the first and second cylinders 302, 306.

Once the target pressure is reached, the bending cylinder 82 is actuated to rotate the support table 272 relative to the base 270. Rotation of the support table 272 causes the end of the workpiece 68 in contact with the roll die 290 or 292 to be bent around the roll die 290 or 292 and generally assume the curvature of the groove 296 or 300 of the first or second roll die 290 or 292. The support table 272 is rotated relative to the base 270 through a desired angular distance to achieve a desired angle of curvature of the workprice 68. That is, although the rotation of the support table 272 is generally equivalent to the desired angle of curvature of the workpiece, the angle of rotation of the support table 272 can be increased to account for spring back of the workpiece 68 material.

During the bending process, the pressure within the workpiece 68 preferably is increased as the bending angle becomes larger. In addition, as is described in greater detail below, preferably the target pressure is adjusted in accordance with the radius of curvature of the bend in the workpiece 68. Preferably, the smaller the radius of curvature, the higher the target pressure.

In the preferred method, the bends in the exhaust pipe 40 or workpiece 68 are created in order from the most downstream end to the most upstream end of the exhaust pipe 40. That is, the first bent portion 48 is produced first, followed by the second bent portion 50, and the third bent portion 52.

After the first bent portion 48 is created, the clamp 260 translates and/or rotates the workpiece 68 into a proper position to create the next bent portion 50. While the position of the workpiece 68 is being changed, the valve 144 diverts the flow of water from the high pressure pump 118 through the discharge conduit 146 to the first tank 94. After creation of the second bent portion 50, the clamp 260 moves the workpiece 68 into position to create the third bent portion 52. The third bent portion 52 is created in a similar manner to the creation of the first and second bent portions 48, 50.

After each of the bent portions 48, 50, 52 are created, the pressure level of the high pressure pump 118 is reduced and water is diverted by the valve 144 through the bypass passage 146 and to the first tank 94. Once the pressure has reduced within the workpiece 68, the high pressure pump 118 is deactivated. The second robot 66 then clamps the workpiece 68 and the clamp 260 and workpiece holding device 80 release the workpiece 68. The second robot 66 then removes the workpiece 68 from the pressurization mechanism 58 and the bending mechanism 60 and moves the workpiece 68 to the emptying mechanism 62. Preferably, another workpiece that can be the same, similar to, or different from the workpiece 68, is loaded into the pressurization mechanism 58 and the bending mechanism 60, so as to maximize the use of each mechanism, and the overall rate at which workpieces are formed.

With the workpiece 68 loaded into the emptying mechanism 62, the first plug 70 is clamped with the first clamp 63*a*. Then the nut 184 is loosened with the disengagement devices 63*c*. After the nut 184 is loosened, the robot 66 draws the workpiece 68 away from the clamp 63*a*, thereby removing the plug 70 from the workpiece. At least some of the water remaining in the workpiece 68 then flows down into the drainage device 104 (FIG. 4) and into the tank 98. The robot 66 then moves the workpiece 68 so that the clamp 63*b* can clamp the second plug 72.

The second plug 72 is then clamped with the second clamp 63*b*. Then the nut 186 is loosened with the disengagement device 63*d*. After the nut 186 is loosened, the robot 66 draws the workpiece 68 away from the clamp 63*b*, thereby removing the plug 72 from the workpiece. Additional water remaining in the workpiece 68 can then flow down into the drainage device 104 (FIG. 4) and into the tank 98.

After the plugs 70, 72 are removed from the workpiece 68, the plugs workpiece 68 is moved to the chute 86 for further processing, and the plugs 70,72 are moved to the used plug receiving device 76*a*, for use with other workpieces. In the illustrated embodiment, the plugs 70,72 are then moved toward the downstream end of the used plug receiving device 76*a*, to a point where the robot 64 can grasp the plugs 70, 72, and transport them to the plug staging area 76.

Figure 12:
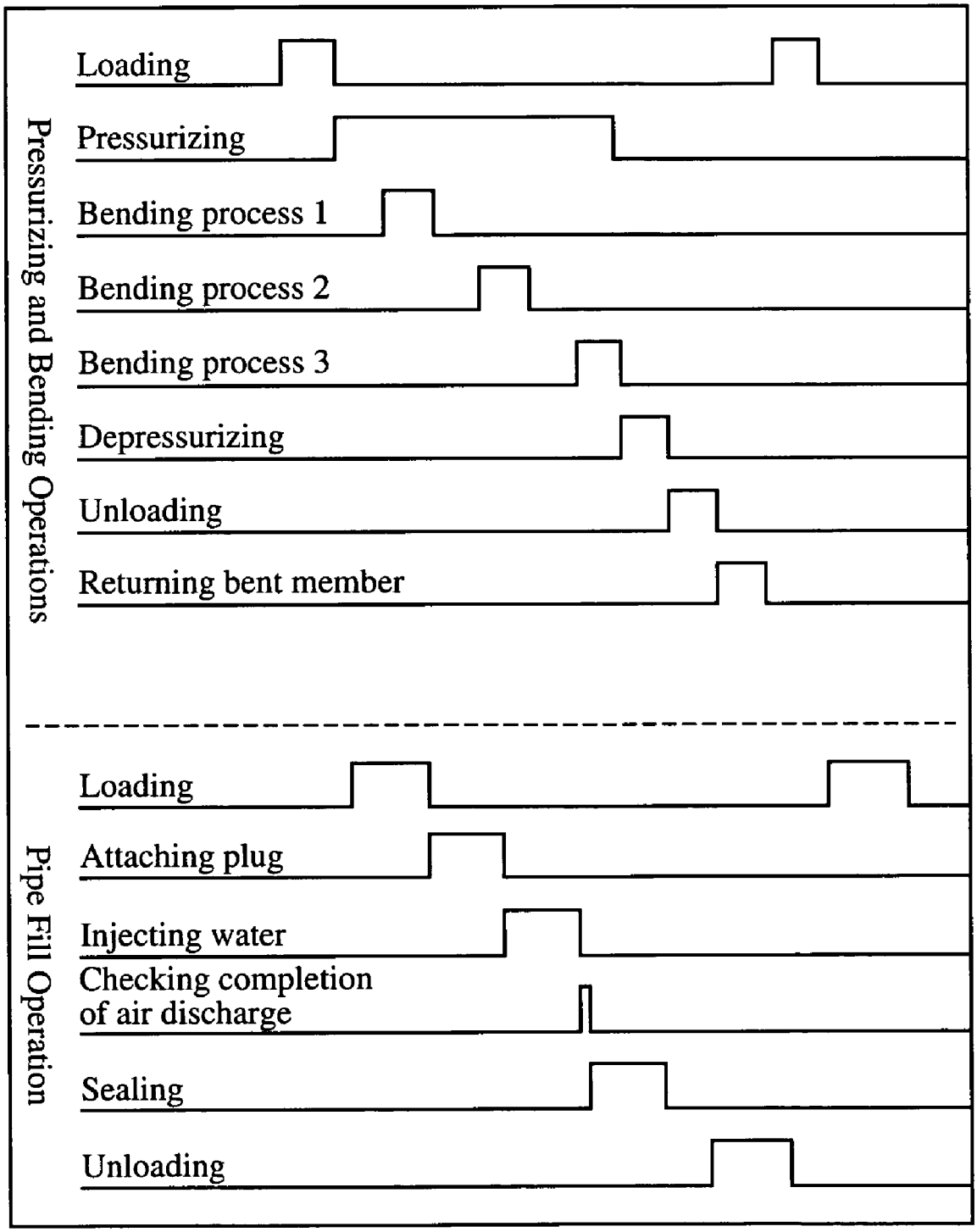
FIG. 12 is a timing chart illustrating relative event timings of a pipe bending method that can be performed with the pipe bending system of FIG. 3.

FIG. 12 includes graphs illustrating non-limiting examples of the relative process time of each process step that can be used in the pressurizing and bending operation and the pipe fill operation, respectively. As described above, preferably, the bending and pipe fill operations are performed at the same time on different workpieces 68. As shown schematically in FIG. 12, the overall process time for the pressurizing and bending operations is generally equivalent to the overall process time for the pipe fill operation. However, the pressurizing and bending operation has a slightly shorter overall process time than the pipe fill operation.

In the upper and lower portions of FIG. 12, the steps of the pressurizing and bending operation and the pipe fill operation are listed in descending order and a timeline is associated with each process step. The timeline extends away from the process step label, toward the right side of the Figure. The period of time consumed by the process step is indicated by the elevated portion of the timeline associated with the process step.

As is illustrated in the upper portion of FIG. 12, the time periods of individual process steps can overlap one another. For example, the pressurizing process overlaps each of the three bending processes (Bending process 1, Bending process 2, and Bending process 3). Thus, as described above, the water within the workpiece 68 is pressurized, during the formation of each bend 48, 50, 52 (FIG. 2) of the exhaust pipe 40.

The pressurizing and bending operation includes a loading operation. For example, the workpiece 68 can be positioned within the pressurization mechanism 58 and the bending mechanism 60. As described above, the pressurizing process step is performed during the first, second, and third bending process steps. After the bending process steps, the water within the workpiece 68 is depressurized in the "depressurizing step", as described above.

After the depressurizing process, the workpiece 68 is unloaded from the bending mechanism 60 in the "Unloading" process. For example, the workpiece 68 can be released from the bending mechanism 60 and removed from the bending mechanism 60 by the robot 66. In the "Returning" process, the workpiece 68 is moved to the pipe emptying mechanism 62. Although not illustrated in FIG. 12, the plugs 70, 72 are removed from the workpiece 68, allowing the water to drain therefrom, during the pressurizing and bending operation.

The pipe fill operation includes a "loading" operation in which the workpiece 68 is positioned in the pipe fill mechanism 56. Thereafter, the first and second plugs 70, 72 are connected to the workpiece 68 in the "Attaching plug" operation. For example, as described above with reference to FIG. 7, the sockets 190 are driven so as to tighten the nuts 184,186 so as to form a watertight seal between the plugs 70, 72 and the workpiece 68.

Once the plugs 70, 72 are assembled to the workpiece 68, water is injected into the interior of the workpiece 68 in the "Injecting water" process. Once the workpiece 68 has been filled with water, the completion of air discharge is confirmed by the air detection sensor 138. This process is identified as "Checking completion of air discharge". After the removal of air bubbles has been confirmed, the system 54 performance a "Sealing" operation.

In the sealing operation, the workpiece 68 is disconnected from the circulation system 90 and sealed so that air is not introduced into the workpiece 68 while the workpiece 68 is transported to the pressurizing mechanism 58. For example, during the sealing process, the pump 116 is stopped and the actuator 135 is operated to close the valve 136. Then the first coupler connecting device 174 disconnects the water supply coupler 128 from the coupler 126 of the first plug 70. Similarly, the discharge coupler 132 is disconnected from the coupler 130 of the second plug 72 by the second coupler connecting device 176.

Finally, the workpiece 68 is removed from the filling mechanism 56 during an "Unloading" operation. For example, the robot 64 can lift the workpiece 68 away from the filling mechanism 56 for transport to the pressurizing mechanism 58. Another "Loading" operation can then begin for loading the next workpiece 68 into the filling mechanism 56.

Figure 13:
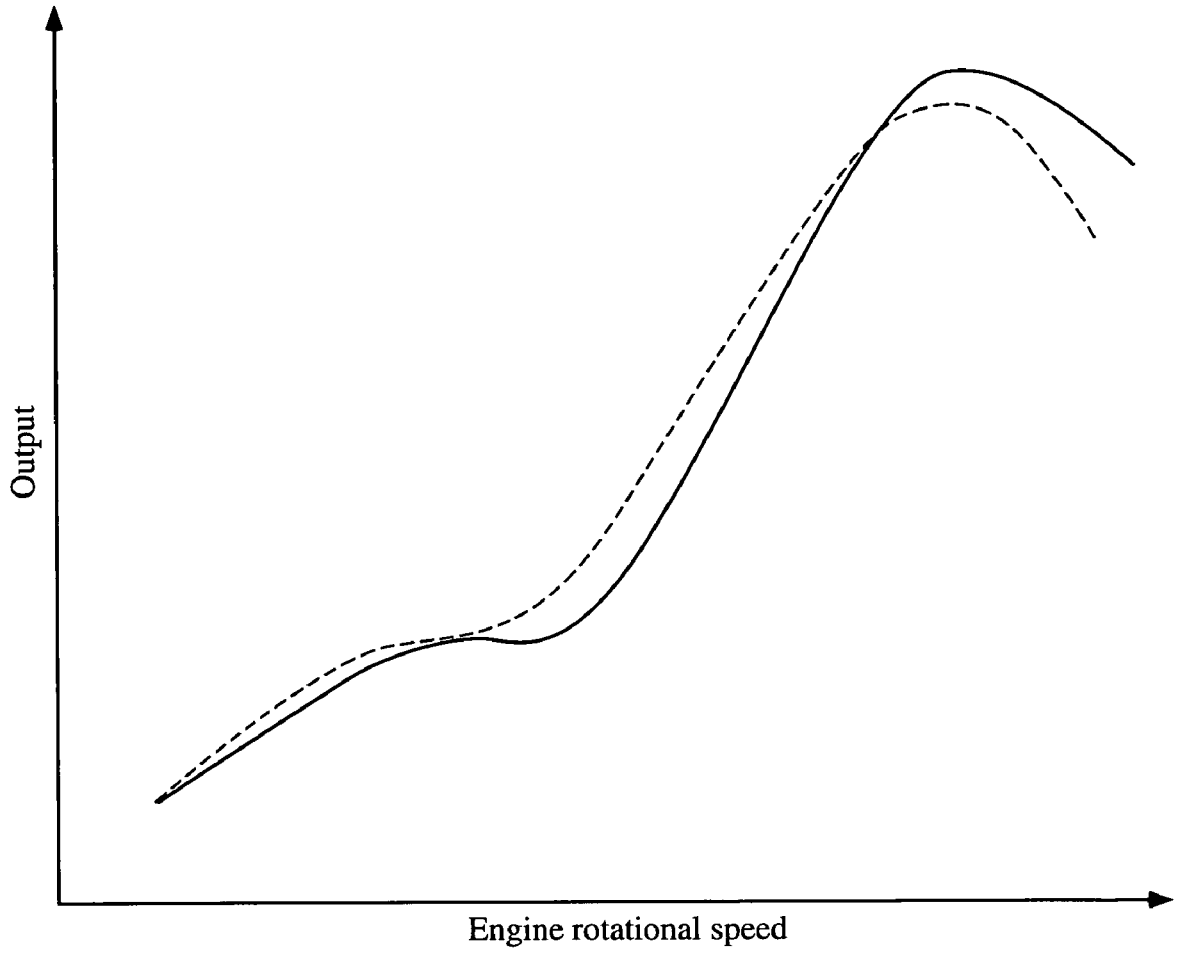
FIG. 13 is a graph with a plot in solid line showing power output versus engine rotational speed of an exhaust pipe produced by the pipe bending system of FIG. 3. A power output versus engine rotational speed curve for a prior art exhaust pipe is shown in phantom.

FIG. 13 is an exemplary graph of power output of the engine 24 versus engine rotational speed, wherein the engine 24 includes the exhaust pipe 40 produced by the above-described method and shown in solid line. The engine power output versus engine rotational speed for an exhaust pipe constructed by a prior art process is illustrated in phantom.

As shown in FIG. 13, the power output for a given rotational speed for the present exhaust pipe 40 is greater than for a conventional exhaust pipe at high engine rotational speeds, where a maximum power output is achieved. The higher power output with the present exhaust pipe 40 at high engine rotational speeds occurs at least partly due to the reduced disruption of exhaust gas flow and reflection of exhaust gas pressure waves due to the more consistent cross-sectional area and shape produced by the above-described method. As illustrated by the graph of FIG. 13, exhaust flow disruptions due to changes in cross-sectional shape or size of the exhaust pipe has a greater effect at higher engine rotational speeds than at lower engine rotational speeds.

Figure 14A:
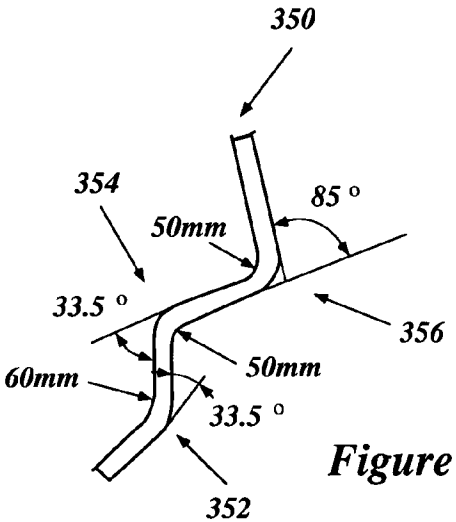
FIG. 14*a* is a schematic view of an illustrative example of an exhaust pipe produced by the pipe bending system of FIG. 3.

FIG. 14*a* illustrates an illustrative and non-limiting example exhaust pipe 350 having first, second and third bends 352, 354, 356. The exhaust pipe 350 preferably has an outside diameter of 38 mm and a wall thickness of 0.85 mm. Desirably, the exhaust pipe 350 is constructed from 304L stainless steel with a circular cross-sectional shape. The first bend 352 preferably has a radius of curvature of 60 mm and a bending angle of 33.5°. The second bend preferably has a radius of curvature of 50 mm and a bending angle of 33.5°. The third bend 356 preferably has a radius of curvature of 50 mm and an angle of curvature of 85°. The specific dimensions described above correspond to one pipe that the system 54 can be configured to produce. Of course, the system 54 can be configured to form pipes having other dimensions and shapes and made from other materials.

Figure 14B:
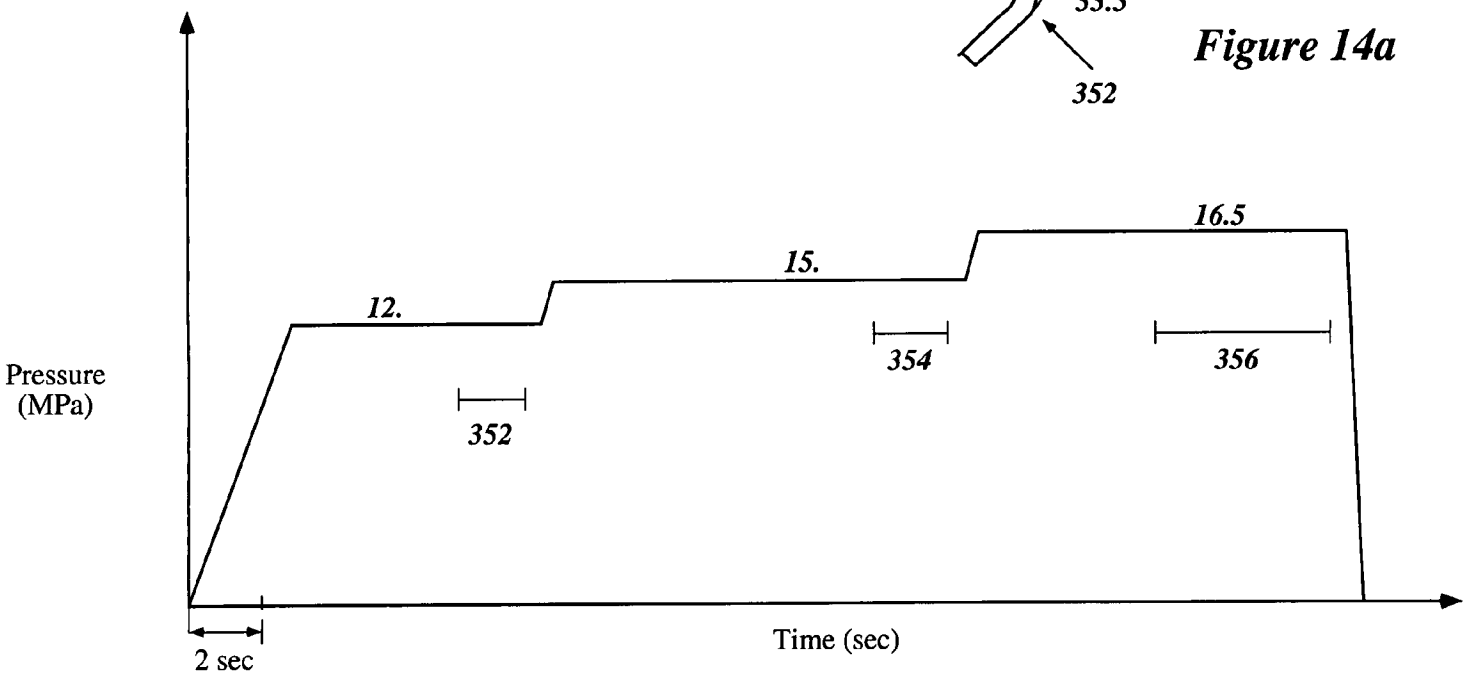
FIG. 14*b* is a graph of the pressure level of the liquid within the exhaust pipe versus time during the bending method of the bending system of FIG. 3.

FIG. 14*b* is a graph of internal water pressure that can be produced within the workpiece 68 by the system 54 over time to produce the bends 352, 354, 356 of the exhaust pipe 350 of FIG. 14*a*. The time period of each bending process to produce the bends 352, 354, 356 are labeled on the graph of FIG. 14*b* with the same numerals. The pressure level of fluid within the workpiece 68 during the bending process preferably is between about 8 and about 30 megapascals (MP) for certain exhaust pipe applications. However, as shown, preferably, a pressure for producing the first bend 352 is approximately 12 megapascals. To create the second bend 354, preferably the internal pressure of the water within the workpiece 68 is approximately 15 MP. The pressure to produce the third bend 356 preferably is about 16.5 MP. Furthermore, other pressure ranges may be used to produce bends in other applications.

Figure 15A:
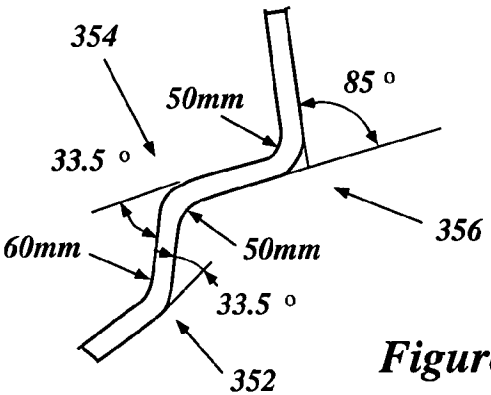
FIG. 15*a* is a schematic illustration of another illustrative example of an exhaust pipe produced by the pipe bending system of FIG. 3.
Figure 15B:
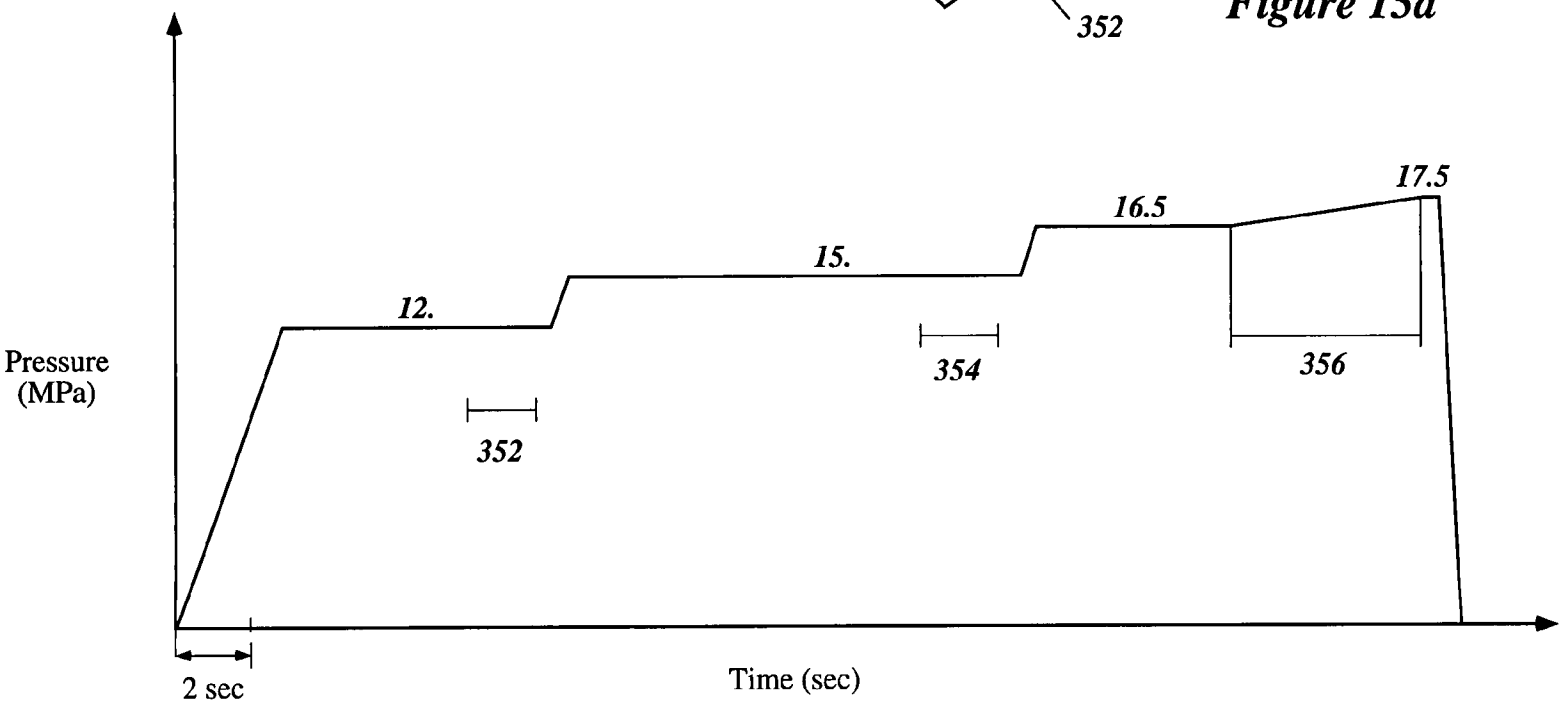
FIG. 15*b* is a graph of the pressure level of a liquid within the exhaust pipe versus time for a preferred method of the pipe bending system of FIG. 3.

FIG. 15*b* is a graph of internal water pressure versus time of a modification of the bending process illustrated by the graph of FIG. 14*b* for producing an exhaust pipe 350 of FIG. 15*a* which has the same dimensions as the pipe 350 illustrated in FIG. 14*a*. As illustrated in FIG. 15*b*, preferably the internal water pressure for the first and second bends 352, 354 is the same as the process of FIG. 14*b*. However, preferably the internal pressure is increased during the creation of the third bend 356 due to the large bending angle of the third bend 356.

As illustrated, preferably the internal water pressure is approximately 16.5 MP at the beginning of the bending step of the third bend 356, and increases during the bending step to a pressure of 17.5 MP at the completion of the bending step. Thus, the internal pressure is increased during the bending step along with an increase in the bending angle of the third bend 356.

Optionally, the internal pressure can be increased with the first bend 352 and/or the second bend 354, or an alternative exhaust pipe having one or more bends with a different radius of curvature and bending angle. In addition, the value of the internal pressure can be varied to suit the workpiece used to create the exhaust pipe, as will be appreciated by one of skill in the art.

To perform the bending operations described above with reference to FIGS. 14*b* and 15*b*, the system 54 can be provided with a computer program, for example in the memory device 93, to cause the control device 92 to monitor the pressure within the workpiece 68 with the sensor 149, and to operate the high pressure pump 118 and the valve 144 to generate the desired pressure within the workpiece 68, as the bending operation proceeds.

Alternatively, control device 92 can be constructed from one or a plurality of hard-wired modules for providing the desired pressures during the bending processes. Optionally, the system 54 can include an input device (not shown) configured to allow an operator to input the target pressures for use during the bending processes. The target pressures for each portion of the bending process can be determined through routine experimentation.

By optimizing the pressure in the workpiece 68 during the bending process, a higher quality pipe can be manufactured. For example, a significant property of exhaust pipes is the uniformity of the inner diameter of the pipe along the length of the pipe. As noted above, one cause of variations in the inner diameter of an exhaust pipe is the bending process. For example, the cross-sectional shape of an exhaust pipe can become flattened or elliptical in the bent portions, as a result of the plastic deformation of the material as it is bent. The uniformity can be expressed as an "aspect" ratio of the outer diameter of the pipe in a bent portion to the, outer diameter of the pipe in a straight portion. By using the devices and methods disclosed above, an exhaust pipe can be manufactured with an aspect ratio of 92% and greater. As such, there is relatively little difference in the inner diameter of the pipe at the bent portions and the straight portions. As such, the flow of exhaust gas therethrough is not hindered and pressure wave reflections are reduced due to the reduced magnitude of constrictions created in bent portions of the pipe, thereby providing better engine output.

In another illustrative example, the workpiece 68 is in the form of a 304L stainless steel pipe having an inner diameter of 38 mm and a wall thickness of 0.8 mm. This workpiece includes three bends, each of which have a radius of curvature of 60 mm. These bends were manufactured with a roll die having a groove with a minimum outer diameter of 58 mm.

In bending this workpiece 68, the water pressure was raised to 110 kg/cm$^2$ for a bending angle of 33.5° and to 155 kg/cm$^2$ for a bending angle of 180°. These conditions resulted in a pipe having a minimum aspect ratio of 97%.

Although the exemplary pipes described herein are made from stainless steel and have round cross sections with a uniform wall thickness. However, the inventions disclosed herein are not limited to stainless steel or workpieces having round cross sections. Rather, the inventions disclosed herein can be applied to workpieces having uneven wall thicknesses, and/or rectangular or polygonal cross sectional shapes. Further, the present inventions can be applied to workpieces made from hot-dip aluminum coated normal steel, or a heat-resistant copper alloy.

Figure 16:
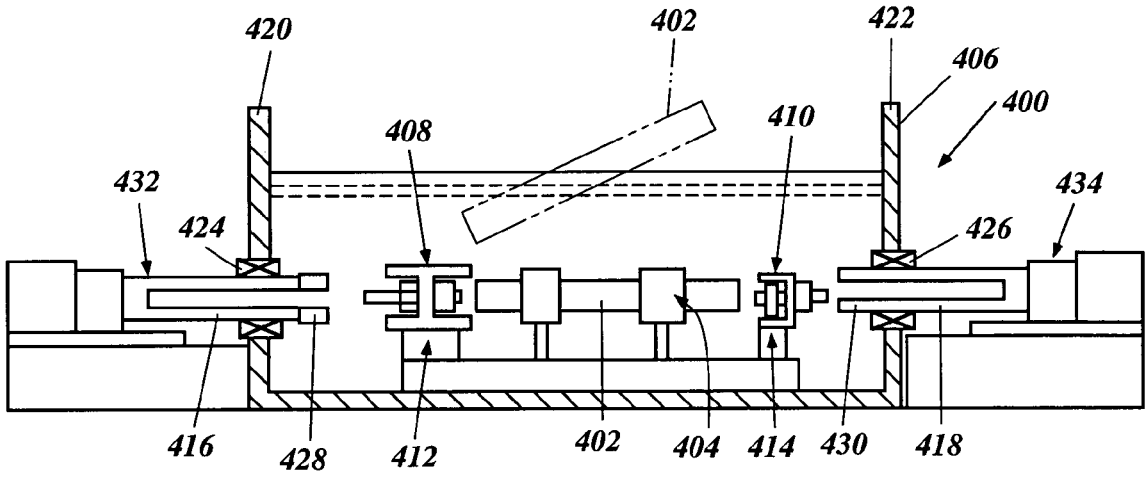
FIG. 16 is a side elevational, partial cross-sectional view of a modification of the plugging device of FIG. 7.

FIG. 16 illustrates an alternative embodiment of a pipe fill mechanism 56, identified generally by the reference numeral 400. Desirably, the pipe fill mechanism 400 provides essentially the same function as the pipe fill mechanism 56 of FIG. 3. That is, the pipe fill mechanism 400 seals first and second ends of a workpiece 402 and fills the interior of the workpiece 402 with a liquid, such as, for example, but without limitation, water.

The pipe fill mechanism 400 includes at least one pipe clamp 404 for holding the workpiece 402 in a horizontal position. However, the mechanism can include additional clamps for holding the workpiece 402. The clamp 404 is disposed within a water tank 406 that is configured to hold an amount of water sufficient to submerge the workpiece 402 held within the clamp 404.

First and second plug clamps 412,414 are mounted within the tank 406, below a level of the water. The clamps 412,414 are configured to hold first and second plugs 408, 410 below a level of the water. Additionally, the clamps 412, 414 are configured to hold the plugs 408, 410 in alignment with the workpiece 402, when the workpiece 402 is held by the clamp 404. The plugs 408, 410 can be the same as the plugs 70, 72 described above with reference to FIG. 8.

First and second shafts 416, 418 extend through apertures in opposing sidewalls 420, 422 of the tank 406. Seals 424, 426 prevent leakage of water between the shafts 416, 418 in the sidewalls 420, 422.

The shafts 416, 418 are configured to support sockets 428, 430. First and second plug attaching devices 432, 434 are configured to rotate and translate the first and second shafts 416, 418, respectively. The sockets 428, 430 engage the first and second plugs 408, 410, respectively, to secure the plugs to opposing ends of the workpiece 402, in a method similar to that described above with relation to the sockets 190 of the pipe fill mechanism 56 illustrated in FIG. 3.

Preferably, in operation, the workpiece 402 is initially lowered into the tank 406 such that as the workpiece 402 is submerged into the water, one end of the workpiece 402 is higher than an opposite end thereof. For example, a robot, such as the robot 64, to the configured to lower the workpiece 402 into the tank 406 with the workpiece 402 held at an angle, such as that schematically illustrated in FIG. 16. Thus, the workpiece 402 is quickly filled water as it is lowered into the tank 406 and any air that may be within the workpiece 402 quickly escapes, before the plugs 408, 410 are attached to the workpiece 402.

Because the workpiece 402 is submerged within the tank during the attachment of the first and second plugs 408, 410, an air discharge process can be eliminated. Accordingly, the second plug 410 is not required to have a valve assembly to allow the discharge of air from within the workpiece 402 and, thus, can be of a more simplified construction.

Although the present invention has been described in the context of preferred embodiments; it will be understood by those of skill in the art that the present invention extends beyond the specifically disclosed embodiments to other alternative embodiments and/or uses of the invention and obvious modifications and equivalents thereof. Accordingly, the invention is to be defined solely by the appended claims.

What is claimed is:

1. A method of forming a bend in a pipe comprising determining a target radius of curvature of the bend, sealing an interior space of the pipe at a desired location of the bend, filling the interior space with a liquid, calculating a target pressure of the liquid as a function of the target radius wherein the target pressure is inversely related to the target radius, pressurizing the liquid to a pressure substantially equal to the target pressure, and manipulating the pipe to form a bend having a radius substantially equal to the target radius.

2. The method of claim 1, further comprising determining a target bending angle of the bend, wherein the calculating of the target pressure of the liquid involves consideration of the target bending angle, wherein the target pressure is directly related to the target bending angle, and the manipulating of the pipe is continued until the bend achieves a bending angle substantially equal to the target bending angle.

3. The method of claim 2, further comprising increasing the target pressure during the manipulation of the pipe.

4. The method of claim 1, further comprising monitoring the liquid pressure during the manipulation of the pipe and maintaining the liquid pressure substantially at the target pressure throughout the manipulation of the pipe.

5. The method of claim 1, wherein the target pressure is between about 8 and 30 Megapascals.

6. A method of forming at least a first and a second bend in a pipe comprising determining a first target radius of curvature of the first bend and a second target radius of curvature of the second bend which is different from the first target radius, creating at least one sealed interior space within the pipe including the locations of the first bend and the second bend, filling the at least one sealed interior space with a liquid, calculating a first target pressure of the liquid for the first bend as a function of the first radius and calculating a second target pressure of the liquid for the second bend as a function of the second radius wherein, if the second target radius is less than the first target radius, the second target pressure is greater than the first target pressure and, if the second target radius is greater than the first target radius, the second target pressure is less than the target pressure of the first bend, pressurizing the liquid to a pressure substantially equal to the first target pressure and manipulating the pipe to form a first bend having a radius substantially equal to the first target radius, pressurizing the liquid to a pressure substantially equal to the second target pressure and manipulating the pipe to form a second bend having a radius substantially equal to the second target radius.

7. The method of claim 6, further comprising determining a first target bending angle of the first bend and a second target bending angle of the second bend, wherein the calculating of the first target pressure and the second target pressure of the liquid involves consideration of the first and second target bending angles, wherein the first target pressure is directly related to the first target bending angle and the second target pressure is directly related to the second target bending angle, and the manipulating of the pipe to form the first bend is continued until the bend achieves a bending angle substantially equal to the first target bending angle and the manipulating of the pipe to form the second bend is continued until the bend achieves a bending angle substantially equal to the second target bending angle.

8. The method of claim 7, further comprising increasing the target pressure during the manipulation of the pipe.

9. The method of claim 6, further comprising monitoring the liquid pressure during the manipulation of the pipe to form the first and second bends and maintaining the liquid pressure substantially at the respective first or second target pressure throughout the manipulation of the pipe.

10. The method of claim 6, wherein the first and second target pressures are between about 8 and 30 Megapascals.

11. A method of forming a bend in a pipe comprising determining a target angle of curvature of the bend, sealing an interior space of the pipe at a desired location of the bend, filling the interior space with a liquid, calculating an initial target pressure of the liquid as a function of the target angle wherein the initial target pressure is directly related to the target angle, pressurizing the liquid to a pressure substantially equal to the initial target pressure, and increasing the pressure of the liquid from the initial target pressure while manipulating the pipe to form a bend having an angle substantially equal to the target angle.

12. The method of claim 11, further comprising increasing the target pressure from the initial target pressure during the manipulation of the pipe.

13. The method of claim 11, wherein the target pressure is between about 8 and 30 Megapascals.

14. A system for forming a bend in a pipe at a bending position, the system comprising a bending assembly including a pipe bending mechanism and a pressurizing mechanism, the system further comprising a memory and a controller, the pipe bending mechanism including a first roll die having a first radius and a second roll die having a second radius smaller than the first radius and being configured to bend the pipe against a selected one of the first roll die and the second roll die, the bending assembly being configured to position the bending position of the pipe relative to the selected one of the first roll die and the second roll die, the pressurizing mechanism being configured to pressurize a liquid within a sealed interior space of the pipe including the bending position, the memory being configured to store a data set for the bend, the data set comprising a target liquid pressure, a selection of one of the first roll die and the second roll die, and a bending position of the pipe, the controller being configured to process the data set to operate the pressurizing mechanism to pressurize the liquid to a pressure substantially equal to the target pressure and operate the pipe bending mechanism to bend the pipe at the bending position utilizing the selected one of the first roll die and the second roll die, wherein the target liquid pressure is greater for the second roll die than for the first roll die.

15. The system of claim 14, wherein the memory is configured to store one or more additional data sets for one or more additional bends.

16. The system of claim 15, wherein the memory is configured to store a relative rotational position of the pipe for each additional bend and wherein the bending assembly is configured to rotate the pipe to the rotational position of each additional bend.

17. The system of claim 14, further comprising a pressure sensor configured to sense a change in pressure of the liquid within the pipe and send a pressure signal indicative of the change in pressure to the controller, wherein the controller is configured to actuate the pressurizing mechanism to pressurize the liquid to substantially maintain the target liquid pressure during the bending of the pipe.

* * * * *

UNITED STATES PATENT AND TRADEMARK OFFICE

CERTIFICATE OF CORRECTION

PATENT NO. : 7,131,312 B2
APPLICATION NO. : 10/617332
DATED : November 7, 2006
INVENTOR(S) : Yoshino et al.

It is certified that error appears in the above-identified patent and that said Letters Patent is hereby corrected as shown below:

On the title page, (56) column 2, under the Other Publications heading, line 3, please delete "87-96" and insert -- 87-98 --, therefor.

At column 2, line 55, please delete "also,includes" and insert -- also includes --, therefor.

At column 17, line 37, please delete "workprice" and insert -- workpiece --, therefor.

Signed and Sealed this

Nineteenth Day of August, 2008

JON W. DUDAS
*Director of the United States Patent and Trademark Office*